US006379880B1

(12) United States Patent
Katoh

(10) Patent No.: US 6,379,880 B1
(45) Date of Patent: Apr. 30, 2002

(54) HEAT-DEVELOPABLE PHOTOSENSITIVE MATERIAL

(75) Inventor: Kazunobu Katoh, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/518,196

(22) Filed: Mar. 3, 2000

(30) Foreign Application Priority Data

Mar. 5, 1999 (JP) ..... 11-057935

(51) Int. Cl.[7] ..... G03C 1/498; G03C 1/34

(52) U.S. Cl. ..... 430/619; 430/531; 430/607; 430/611; 430/613; 430/617; 430/955; 430/957

(58) Field of Search ..... 430/619, 611, 430/617, 607, 613, 531, 957, 203, 955

(56) References Cited

U.S. PATENT DOCUMENTS 4,840,871 A 6/1989 Peters et al.
4,845,018 A * 7/1989 Sato et al. ..... 430/203
5,298,390 A * 3/1994 Sakizadeh et al. ..... 430/619
5,300,420 A * 4/1994 Kenny et al. ..... 430/615
5,747,237 A * 5/1998 Fukui et al. ..... 430/596
5,763,153 A * 6/1998 Tsuzuki et al. ..... 430/584
6,025,122 A * 2/2000 Sakai et al. ..... 430/619

FOREIGN PATENT DOCUMENTS

EP 0803765 A1 10/1997
EP 0869391 A1 10/1998

* cited by examiner

*Primary Examiner*—Thorl Chea
(74) *Attorney, Agent, or Firm*—Birch, Stewart, Kolasch & Birch, LLP

(57) ABSTRACT

A heat-developable photosensitive material having: (a) at least one layer of photosensitive image-forming layer containing an organic silver salt, a photosensitive silver halide, a reducing agent and an organic binder; and (b) a functional layer containing a binder and a solid dispersion; the binder consisting of a water-dispersed thermoplastic resin, and the solid dispersion being made of a precursor of a photographically useful compound capable of releasing the photographically useful compound when heated to 100° C. or higher and not higher than heat development temperature is disclosed.

11 Claims, No Drawings

HEAT-DEVELOPABLE PHOTOSENSITIVE MATERIAL

FIELD OF THE INVENTION

The present invention relates to a heat-developable photosensitive material capable of forming image by heat development without an aid of developing solution, and in particular to a heat-developable photosensitive material with less temperature dependence in heat development, stable performance against fluctuation in heat development conditions, and high gradation hardness.

BACKGROUND OF THE INVENTION

Recording materials capable of forming image by heat development process are described in U.S. Pat. Nos. 3,152,904 and 3,457,075, and in "Imaging Processes and Materials", Neblette's 8th edition (1969), p.279–291. Heat-developable recording materials disclosed in these literatures contain reducible silver source (e.g. organic silver salt), a catalytic amount of photocatalyst (e.g. silver halide), color-tone adjuster for controlling tone of silver, and reducing agent, all of which are dispersed in a binder. While these heat-developable photosensitive materials are stable at room temperature, they produce blackened silver when heated, after light exposure, to a high temperature (e.g. 120° C.) through redox reaction between the reducible silver source and the reducing agent. This reaction is promoted by a catalytic action of latent image generated by the exposure.

Such recording materials for heat development are increasingly attracting attention as the ones to be combined with, for example, a laser image forming apparatus, since an image forming process using such materials requires no processing liquid such as developing solution but only heating, and therefore generates neither sulfurous acid gas nor ammonia gas. The laser image forming apparatus is utilized in medical, printing plate making, industrial and many other fields.

In general, a temperature of 100° C. or above and a heating time of 10 to 60 seconds are required to develop these heat-developable photosensitive materials. A variety of heat development apparatus has been proposed to enable such development. Known types of the apparatus include such that contacting a photosensitive material with a heat plate or heat roller to heat it by heat conduction; such that heating the material by passing it through an oven; such that generating heat within a layer of the material using electromagnetic wave; and such that using heat generated by current supply to a resistor substance (e.g. carbon black).

In all cases for using these apparatuses, it is critical to keep an entire surface of the photosensitive material layer at an uniform temperature, so that various approaches have been made for the heat development apparatuses. The uniformity of the temperature can, however, only be controllable within ±0.5° C. in practice. Keeping the temperature uniformity may become more difficult for a case with photosensitive material for printing plate making, since more wider area of so-called A-1 size (594×841 mm) or B-1 size (728×1030 mm) may be developed. It is thus desirable that the photosensitive material has a relatively wide latitude against fluctuations in the development temperature.

In recent years, a material based on infectious development by an ultrahigh contrast agent is under investigation as a heat-developable photosensitive material for printing plate making. A problem, however, emerged that the super gradation hardness is quite sensitive to fluctuations in heat development temperature. Changes in super gradation hardness may alter halftone dots' density and line width, so that basic performance of heat-developable photosensitive material for printing plate making cannot be satisfied. It is thus critical to improve the temperature dependence in heat development for a successful use of the heat-developable photosensitive material in such field.

Gradation hardeners for producing high-contrast image ever known include acylhydrazine derivatives disclosed in U.S. Pat. No. 5,464,738, U.S. Pat. No. 5,512,411, U.S. Pat. No. 5,496,695 and U.S. Pat. No. 5,536,622;

acrylonitrile derivatives disclosed in U.S. Pat. Nos. 5,545,515 and 5,635,339; malondialdehydes disclosed in U.S. Pat. No. 5,654,130; and isoxazoles disclosed in U.S. Pat. No. 5,705,324. Known compounds for accelerating development include amine compounds disclosed in U.S. Pat. No. 5,545,505; hydroxamic acids disclosed in U.S. Pat. No. 5,545,507; and hydrogen atom donors disclosed in U.S. Pat. No. 5,637,449, all of which are added to an image-forming layer together with the ultrahigh contrast agents.

There has, however, been a sustained need for creating a more advancing heat-developable photosensitive material capable of being stably developed.

SUMMARY OF THE INVENTION

It is therefore an object of the present invention to provide a solution for the above-described problems. That is, the present invention is aimed at providing an improved heat-developable photosensitive material, and more specifically, a heat-developable photosensitive material capable of being stably developed. In more detail, the present invention is aimed at providing a heat-developable photosensitive material having less dependence on development temperature, retaining stable property against fluctuations in heat development conditions and having a high gradation hardness.

The present inventors found out, after extensive studies, that an excellent heat-developable photosensitive material producing a desired effect is obtainable by using a precursor for photographically useful compound capable of releasing the photographically useful compound when heated at specific temperatures, which has led us to the present invention.

That is, the present invention provides a heat-developable photosensitive material comprising: (a) at least one layer of photosensitive image-forming layer containing an organic silver salt, a photosensitive silver halide, a reducing agent and an organic binder; and (b) a functional layer containing a binder and a solid dispersion; the binder consisting of a water-dispersed thermoplastic resin, and the solid dispersion being made of a precursor of a photographically useful compound capable of releasing the photographically useful compound when heated to 100° C. or higher and not higher than heat development temperature.

The photographically useful compounds is preferably a development inhibitor or development accelerator. The heat-developable photosensitive material of the present invention preferably contains an ultrahigh contrast agent, and the organic binder in the photosensitive image-forming layer is preferably produced from a water-dispersed thermoplastic resin. The functional layer preferably contains a photosensitive silver halide.

The precursor of the photographically useful compound is preferably selected as either of the compounds having formulae (1) or (2) below:

$$R^{10}—CHR^{11}—CR^{12}R^{13}—A^{11} \quad (1)$$

(where, $R^{10}$ represents an electron attractive group, $R^{11}$, $R^{12}$ and $R^{13}$ independently represent a hydrogen atom, alkyl group which may be substituted, or aryl group which may be substituted, and $A^{11}$ represents a photographically useful group bonded through a hetero atom), $$R^{21}—S—SO_2—R^{22} \quad (2)$$

(where, $R^{21}$ and $R^{22}$ independently represent an aliphatic hydrocarbon group, aryl group, alkoxycarbonyl group, aryloxycarbonyl group or heterocyclic group, all of which may be substituted).

The heat-developable photosensitive material of the present invention is less dependent on development temperature, less sensitive to temperature nonuniformity in a heat developing apparatus, and capable of stable production of uniform image. In particular, the material is exceptionally useful since it can afford image with super gradation hardness and uniformity favorable to printing plate making.

DETAILED DESCRIPTION OF THE INVENTION

Embodiments and specific ways of practicing the heat-developable photosensitive material of the present invention will be explained in detail hereinafter.

The heat-developable photosensitive material of the present invention is characterized in that comprising: (a) at least one layer of photosensitive image-forming layer containing an organic silver salt, a photosensitive silver halide, a reducing agent and an organic binder; and (b) a functional layer containing a binder and a solid dispersion; the binder consisting of a water-dispersed thermoplastic resin, and the solid dispersion being made of a precursor of a photographically useful compound.

In the present invention, the precursor of the photographically useful compound used in the functional layer is such a compound that can release the photographically useful compound when heated to 100° C. or higher and not higher than heat development temperature. A variety of compounds is available as the precursor of the photographically useful compound, and the types of which being of no particular limitation.

As one non-limitative example of the precursor of the photographically useful compound, exemplified is a compound having the general formula (1) below:

$$R^{10}—CHR^{11}—CR^{12}R^{13}—A^{11} \quad (1)$$

where in the general formula (1), $R^{10}$ represents an electron attractive group; $R^{11}$, $R^{12}$ and $R^{13}$ independently represent a hydrogen atom, alkyl group which may be substituted, or aryl group which may be substituted; and $A^{11}$ represents a photographically useful group bonded through a hetero atom.

The electron attracting group represented by $R^{10}$ in the general formula (1) is such a group having a Hammett's$\sigma_p$ value of 0 or larger. Typical $\sigma_p$ values of various substituents are described in Chemical Review, vol. 91, p.165–195 (1991).

Favorable examples of $R^{10}$ include alkylcarbonyl group, arylcarbonyl group, alkoxycarbonyl group, aryloxycarbonyl group, nitrile (cyano) group, alkylcarbamoyl group, dialkylcarbamoyl group, carboxyl group and aldehyde group. More favorable groups for $R^{10}$ include alkylcarbonyl group, arylcarbonyl group, alkoxycarbonyl group, aryloxycarbonyl group and nitrile group, and still more favorable ones include alkylcarbonyl group, arylcarbonyl group and nitrile group. These groups may have some substituent if they are substitutable, and preferable substituents are exemplified as those indicated by Y, which will be described later.

Favorable examples of $R^{10}$ as depicted from another aspect include cyano group and that expressed as C(=O)—Z, where Z represents a necessary atomic group to form, together with the carbonyl group adjacent thereto, ketone, ester, amide, carboxylic acid or aldehyde.

Still further favorable example of $R^{10}$ can be a group having a structure expressed by the formula (3) below:

(3)

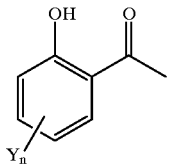

where, Y represents a hydrogen atom or univalent substituent, and n represents an integer of 0 to 4. Substituents expressed as Y include halogen atom (e.g. fluorine atom, chlorine atom, bromine atom, iodine atom); normal-, branched- or cyclic alkyl group (preferably with a carbon number of 1 to 20, more preferably 1 to 12, and still more preferably 1 to 8, exemplified as methyl, ethyl, isopropyl, tert-butyl, n-octyl, n-amyl, tert-amyl and cyclohexyl); alkenyl group (preferably with a carbon number of 2 to 20, more preferably 2 to 12, and still more preferably 2 to 8, exemplified as vinyl, allyl, 2-butenyl and 3-pentenyl); aryl group (preferably with a carbon number of 6 to 30, of 6 to 30, more preferably 6 to 20, and still more preferably 6 to 12, exemplified as phenyl, p-methylphenyl and naphthyl); hydroxyl group; alkoxy group (preferably with a carbon number of 1 to 20, more preferably 1 to 12, and still more preferably 1 to 8, exemplified as methoxy, ethoxy and butoxy); aryloxy group (preferably with a carbon number of 6 to 20, more preferably 6 to 16, and still more preferably 6 to 12, exemplified as phenyloxy and 2-naphthyloxy); acyloxy group (preferably with a carbon number of 1 to 20, more preferably 2 to 16, and still more preferably 2 to 10, exemplified as acetoxy and benzoyloxy); amino group (preferably with a carbon number of 0 to 14, more preferably 0 to 10, and still more preferably 0 to 6, exemplified as dimethylamino, diethylamino and dibutylamino); acylamino group (preferably with a carbon number of 1 to 20, more preferably 2 to 16, and still more preferably 2 to 10, exemplified as acetylamino and benzoylamino); sulfonylamino (preferably with a carbon number of 1 to 20, more preferably 1 to 16, and still more preferably 1 to 12, exemplified as methanesulfonylamino and benzene sulfonylamino); ureide group (preferably with a carbon number of 1 to 20, more preferably 1 to 16, and still more preferably 1 to 12, exemplified as ureide, methylureide and phenylureide); carbamate group (preferably with a carbon number of 2 to 20, more preferably 2 to 16, and still more preferably 2 to 12, exemplified as methoxycarbonylamino and phenyloxycarbonylamino); carboxyl group; carbamoyl group (preferably with a carbon number of 1 to 20, more preferably 1 to 16, and still more preferably 1 to 12, exemplified as carbamoyl, N,N-diethylcarbamoyl, N-hexadecylcarbamoyl and N-phenylcarbamoyl); acyl group (preferably with a carbon number of 1 to 20, more preferably 1 to 16, and still more preferably 1 to 12, exemplified as acetyl, benzoyl, formyl and pivaloyl); sulfo group; sulfonyl group (preferably with a carbon number of 1 to 20, more preferably 1 to 16, and still more preferably 1 to 12, exemplified as mesyl, octylsulfonyl and tosyl); sulfamoyl group (preferably with a carbon number of 0 to 20, more preferably 0 to 16, and still more preferably 0 to 12, exemplified as sulfamoyl, methylsulfamoyl, dimethylsulfamoyl and phenylsulfamoyl); cyano group; and nitro group.

These substituents may have a further substituent, and may form a salt if they are salt-formable. While n represents an integer of 0 to 4, multiple Ys can be the same or differ from each other when n is an integer of 2 or above. When n is an integer of 2 or above, Ys can combine with each other to form a ring (e.g. benzene ring).

In the general formula (1), $R^{11}$, $R^{12}$ and $R^{13}$ independently represent a hydrogen atom, alkyl group which may be substituted, or aryl group which may be substituted.

The alkyl group expressed by $R^{11}$, $R^{12}$ or $R^{13}$ is such having a straight or branched skeleton. A preferred carbon number of the alkyl group is 1 to 20, more preferably 1 to 12, and still more preferably 1 to 8. Preferred examples of the alkyl group are exemplified as methyl, ethyl, n-propyl, n-butyl, isobutyl and n-octyl.

The aryl group expressed by $R^{11}$, $R^{12}$ or $R^{13}$ is substituted or unsubstituted aryl group preferably having a carbon number of 6 to 20, more preferably 6 to 15, and still more preferably 6 to 10. Preferred examples of the aryl group are exemplified as phenyl, 1-naphthyl and 2-naphthyl.

The alkyl group or aryl group expressed by $R^{11}$, $R^{12}$ or $R^{13}$ may further contain a substituent. Groups as expressed with Y described above can be selected as the substituent.

$R^{11}$, $R^{12}$ or $R^{13}$ is most preferably selected as a hydrogen atom, methyl group, ethyl group or phenyl group.

In the general formula (1), $A^{11}$ represents a photographically useful group bonded through a hetero atom. "Photographically useful group" in the context of this specification means a group composing a photographically useful material released from the precursor of the photographically useful compounds when the precursor is heated to 100° C. or higher and not higher than heat development temperature.

"Photographically useful compound" in the context of this specification means a compound exerting an useful function at the time of heat development of the heat-developable photosensitive material after light exposure. Exceptionally favorable example of the photographically useful compound is, for example, a compound capable of improving temperature dependence in heat development. Specific examples of the photographically useful compound include those acting as antifogging agent, development inhibitor, development accelerator or image stabilizing agent (for preventing color fading as well as printing out), while not particularly being limited thereto. Many of the photographically useful compounds are already known in the related art and can appropriately be selected by those skilled in the art. Specific examples of the photographically useful compound include mercaptotetorazoles, mercaptotriazoles, mercaptothiazoles, mercaptobenzothiazoles, mercaptobenzooxazoles, mercaptobenzoselenazoles, benzotriazoles, indazoles, mercaptooxadiazole and mercaptotriazines, while not particularly being limited thereto.

The photographically useful group can, in general, be derived from the photographically useful compound. The photographically useful group is derived so that its hetero atom is bound to a carbon atom on which $R^{12}$ and $R^{13}$ are bound. Such hetero atom can be exemplified as oxygen, nitrogen, sulfur, selenium or tellurium, while not particularly being limited thereto.

Among the compounds expressed by the general formula (1), preferable is a family of compounds whose $R^{10}$ is a cyano group or —C(=O)—Z, where Z represents an atomic group required to form, together with the carbonyl group adjacent thereto, ketone, ester, amide, carboxylic acid or aldehyde.

Among the compounds expressed by the general formula (1), more preferable is a family of compounds whose $R^{10}$ is a group having a structure expressed by the formula (3) shown above, where Y represents a hydrogen atom or univalent substituent.

Next, specific examples of the compounds expressed by the general formula (1) are enumerated below, while not being limited thereto in the present invention:

(D-1)

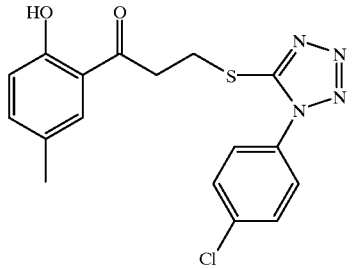

(D-2)

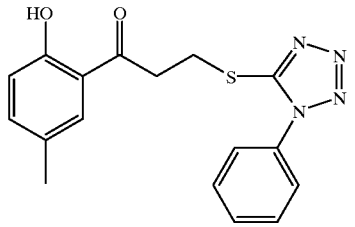

(D-3)

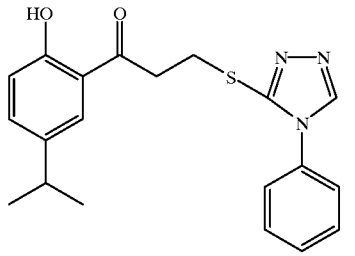

(D-4)

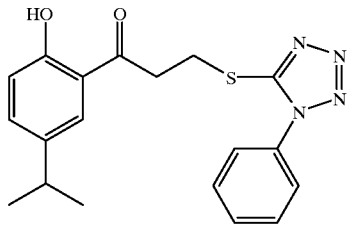

-continued
(D-5)
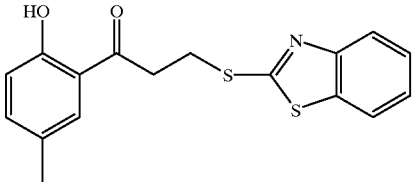
(D-6)
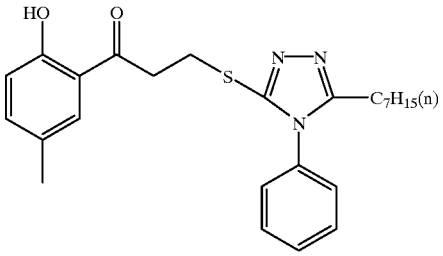
(D-7)
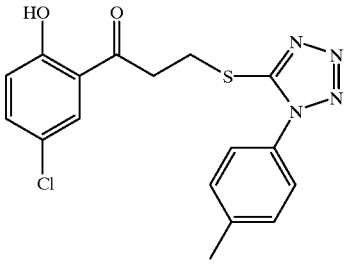
(D-8)
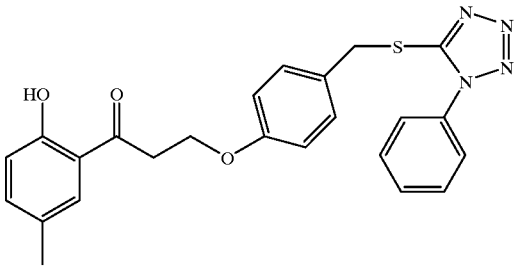
(D-9)
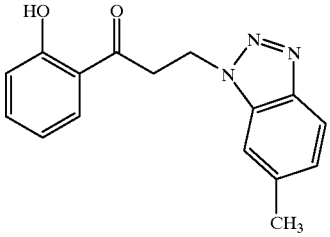
(D-10)
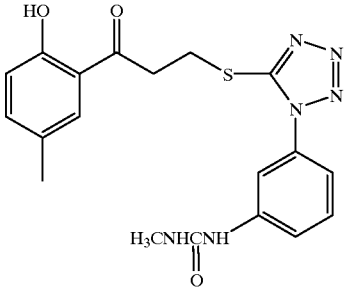
-continued
(D-11)
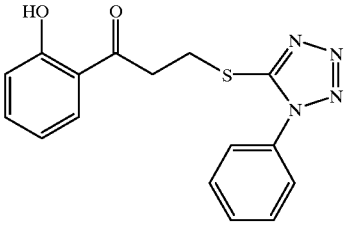
(D-12)
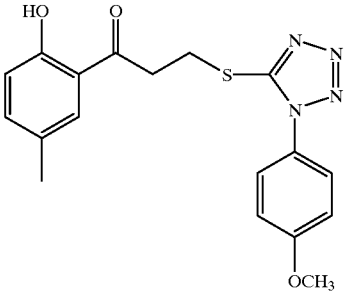
(D-13)
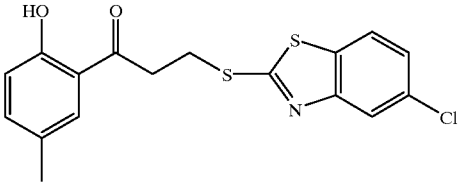
(D-14)
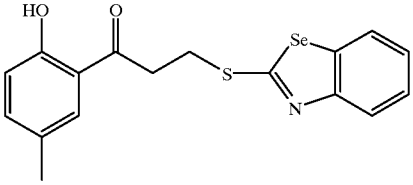
(D-15)
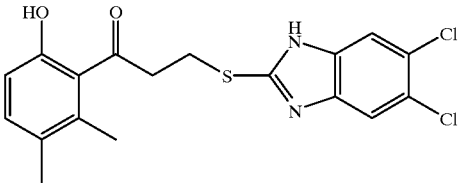
(D-16)
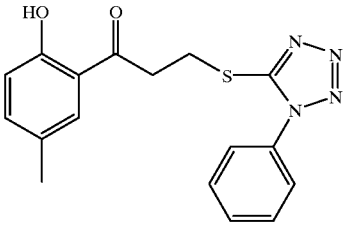

-continued
(D-17)
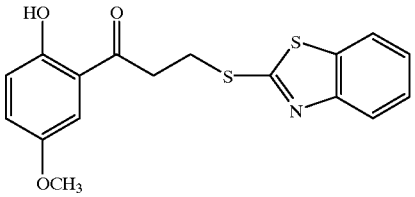
(D-18)
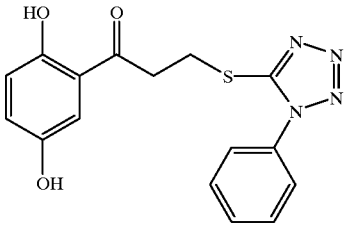
(D-19)
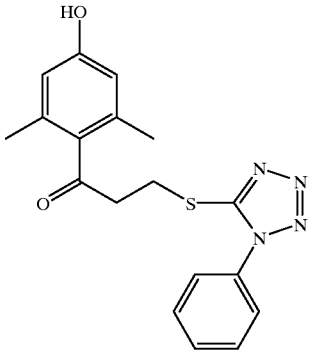
(D-20)
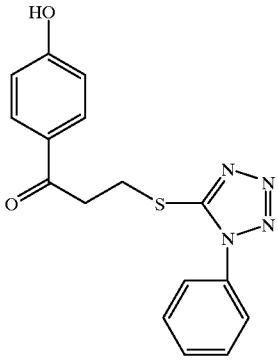
(D-21)
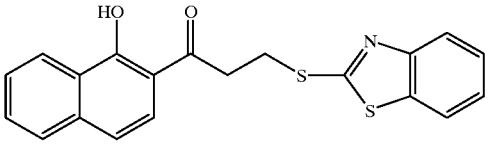
(D-22)
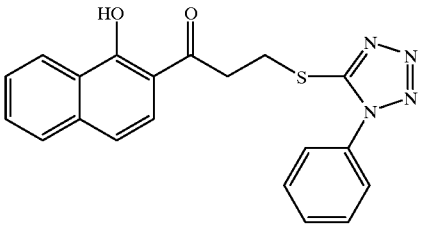
-continued
(D-23)
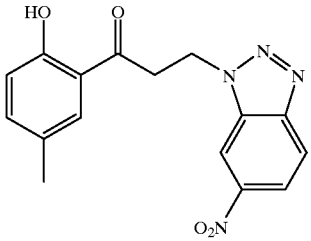
(D-24)
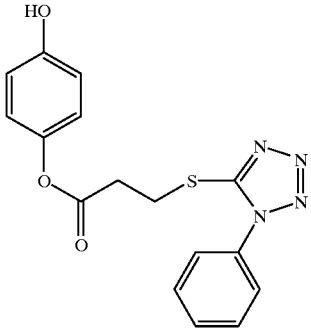
(D-25)
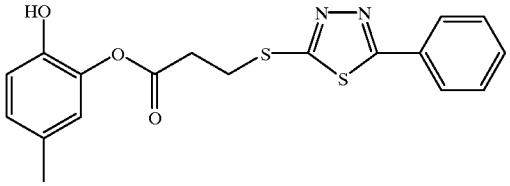
(D-26)
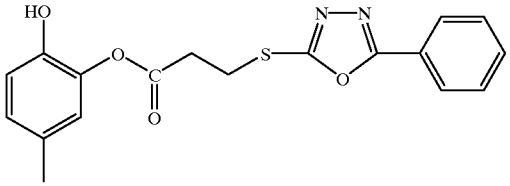
(D-27)
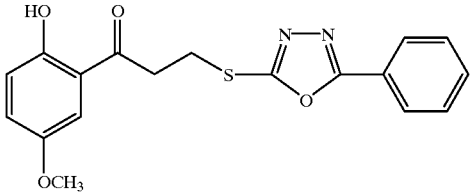
(D-28)
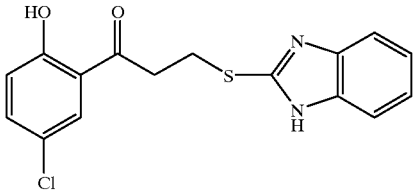

-continued
(D-29)
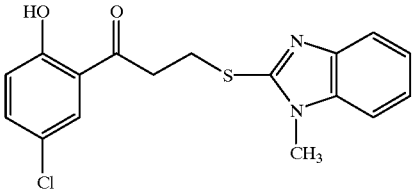
(D-30)
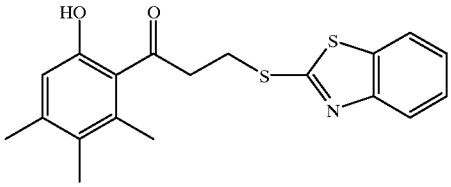
(D-31)
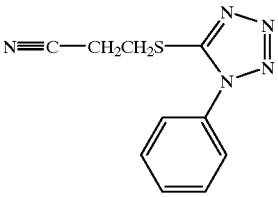
(D-32)
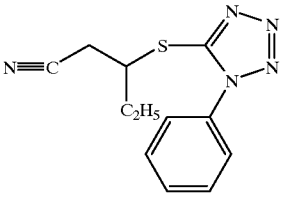
(D-33)
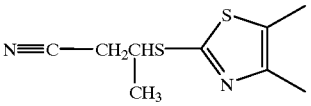
(D-34)
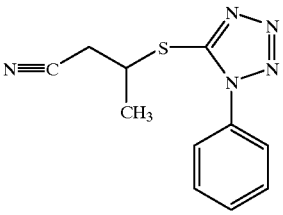
(D-35)
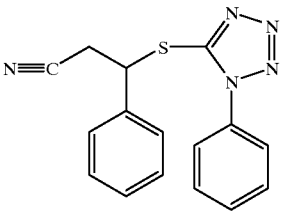
(D-36)
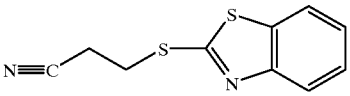
-continued
(D-37)
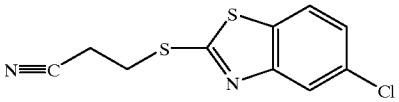
(D-38)
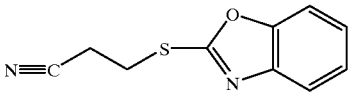
(D-39)
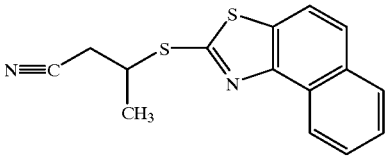
(D-40)
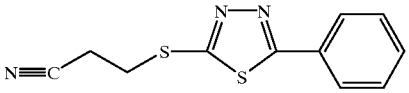
(D-41)
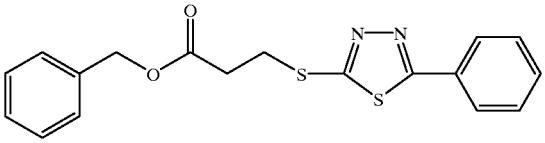
(D-42)
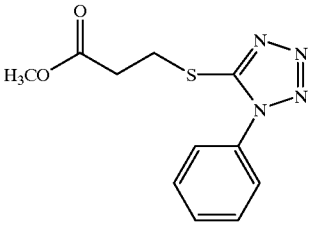
(D-43)
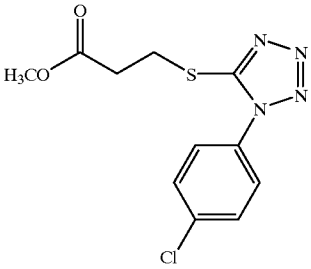
(D-44)
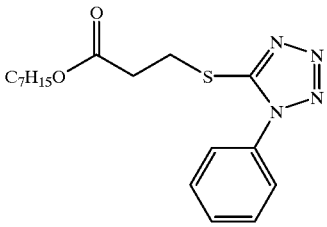

-continued (D-45)

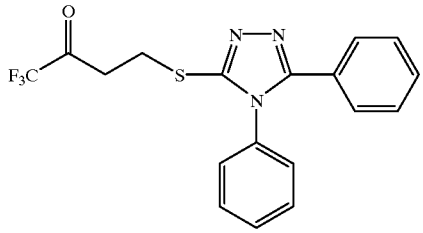

(D-46)

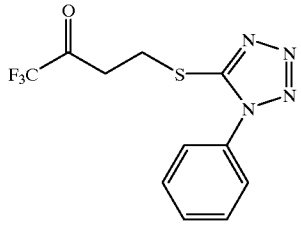

(D-47)

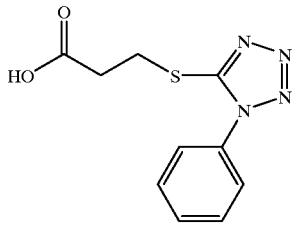

(D-48)

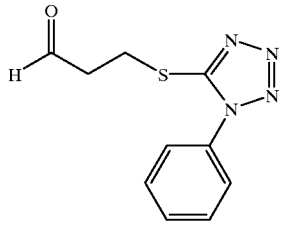

(D-49)

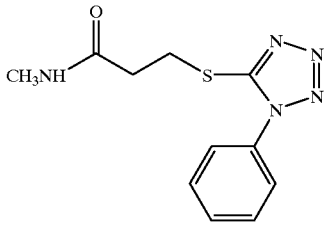

(D-50)

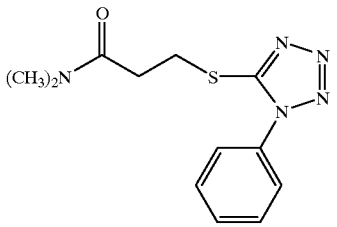

The compounds expressed by the general formula (1) in the present invention can be synthesized according to the methods described in JPA-59-137945, JPA-59-140445 and JP-A-9-258357, (the code "JP-A" as used herein means an "unexamined published Japanese patent application"), and in Journal of Chemical Society (c), p.283 (1970).

The compounds expressed by the general formula (1) can be used in the present invention as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The compounds can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid of a ball mill, colloid mill, sand grinder mill, manthonegalling, micro-fluidizer or ultrasonic wave.

In the present invention, the compounds of the general formula (1) are preferably used in an amount, as expressed by a molar amount per 1 mole of silver, from $1\times10^{-5}$ to $5\times10^{-1}$ mol/mol Ag, and more preferably from $5\times10^{-5}$ to $1\times10^{-1}$ mol/mol Ag, and still more preferably from $1\times10^{-4}$ to $5\times10^{-2}$ mol/mol Ag. These compounds can be used either in an independent manner or in a combined manner involving two or more thereof.

As another non-limitative example of the precursor of the photographically useful compound, exemplified is a compound having the general formula (2) below:

$$R^{21}—S—SO_2—R^{22} \quad (2)$$

where in the general formula (2), $R^{21}$ and $R^{22}$ independently represent an aliphatic hydrocarbon group, aryl group, alkoxycarbonyl group, aryloxycarbonyl group or heterocyclic group, all of which may be substituted.

The aliphatic hydrocarbon group represented by $R^{21}$ or $R^{22}$ in the general formula (2) is preferably a normal, branched or cyclic alkyl group (preferably with a carbon number of 2 to 20, more preferably 2 to 16, and still more preferably 2 to 12); alkenyl group (preferably with a carbon number of 2 to 20, more preferably 2 to 16, and still more preferably 2 to 12); and alkynyl group (preferably with a carbon number of 2 to 20, more preferably 2 to 16, and still more preferably 2 to 12); all of which may have a substituent.

The favorable substituent include aryl group (preferably with a carbon number of 6 to 30, more preferably 6 to 20, and still more preferably 6 to 12, exemplified as phenyl, p-methylphenyl and naphthyl); amino group (preferably with a carbon number of 0 to 20, more preferably 0 to 10, and still more preferably 0 to 6, exemplified as amino, methylamino, dimethylamino, diethylamino and dibenzylamino); alkoxy group (preferably with a carbon number of 1 to 20, more preferably 1 to 12, and still more preferably 1 to 8, exemplified as methoxy, ethoxy and butoxy); aryloxy group (preferably with a carbon number of 6 to 20, more preferably 6 to 16, and still more preferably 6 to 12, exemplified as phenyloxy and 2-naphthyloxy); acyl group (preferably with a carbon number of 1 to 20, more preferably 1 to 16, and still more preferably 1 to 12, exemplified as acetyl, benzoyl, formyl and pivaloyl); alkoxycarbonyl group (preferably with a carbon number of 2 to 20, more preferably 2 to 16, and still more preferably 2 to 12, exemplified as methoxycarbonyl and ethoxycarbonyl); aryloxycarbonyl group (preferably with a carbon number of 7 to 20, more preferably 7 to 16, and still more preferably 7 to 10, exemplified as phenoxycarbonyl); acyloxy group (preferably with a carbon number of 1 to 20, more preferably 2 to 16, and still more preferably 2 to 10, exemplified as acetoxy and benzoyloxy); acylamino group (preferably with a carbon number of 1 to 20, more preferably 2 to 16, and still more preferably 2 to 10, exemplified as acetylamino and benzoylamino); alkoxycarbonylamino group (preferably with a carbon number of 2 to 20, more preferably 2 to 16, and still more preferably 2 to 10, exemplified as methoxycarbonylamino); aryloxycarbonylamino group (preferably with a carbon number of 7 to 20, more preferably 7 to 16, and still more preferably 7 to 12, exemplified as phenyloxycarbonylamino); sulfonylamino (preferably with a carbon number of 1 to 20, more preferably 1 to 16, and still more preferably 1 to 12, exemplified as methanesulfonylamino and benzenesulfonylamino); sulfamoyl group (preferably with a carbon number of 0 to 20, more preferably 0 to 16, and still more preferably 0 to 12, exemplified as sulfamoyl, methylsulfamoyl, dimethylsulfamoyl and phenylsulfamoyl); carbamoyl group (preferably with a carbon number of 1 to 20, more preferably 1 to 16, and still more preferably 1 to 12, exemplified as carbamoyl, N,N-diethylcarbamoyl, and N-phenylcarbamoyl); ureide group (preferably with a carbon number of 1 to 20, more preferably 1 to 16, and still more preferably 1 to 12, exemplified as ureide, methylureide and phenylureide); alkylthio group (preferably with a carbon number of 1 to 20, more preferably 1 to 16, and still more preferably 1 to 12, exemplified as methylthio and ethylthio); arylthio group (preferably with a carbon number of 6 to 20, more preferably 6 to 16, and still more preferably 6 to 12, exemplified as phenylthio); sulfonyl group (preferably with a carbon number of 1 to 20, more preferably 1 to 16, and still more preferably 1 to 12, exemplified as mesyl and tosyl); sulfinyl (preferably with a carbon number of 1 to 20, more preferably 1 to 16, and still more preferably 1 to 12, exemplified as methanesulfinyl and benzenesulfinyl); phosphoric acid amide group (preferably with a carbon number of 1 to 20, more preferably 1 to 16, and still more preferably 1 to 12, exemplified as diethylphosphoric acid amide and phenylphosphoric acid amide); hydroxyl group; mercapto group; halogen atom (e.g. fluorine atom, chlorine atom, bromine atom, iodine atom); cyano group; sulfo group; carboxyl group; nitro group; hydroxam group; sulfino group; hydrazino group; sulfonylthio group; thiosulfonyl group; and heterocyclic group (exemplified as imidazolyl, pyridyl, furyl, piperidyl and morpholino). These substituents may have further substituent. For the case with two or more substituents, these substituents may be the same or may differ from each other.

Favorable substituents for the aliphatic hydrocarbon group expressed by $R^{21}$ or $R^{22}$ in the general formula (2) include aryl group, alkoxy group, heterocyclic group, cyano group, acyl group, alkoxycarbonyl group, sulfamoyl group, carbamoyl group, sulfonyl group, and nitro group; and among these more preferable are heterocyclic group, cyano group, acyl group, sulfonyl group and nitro group.

Preferable aliphatic hydrocarbon groups expressed by $R^{21}$ or $R^{22}$ refer to alkyl group, and more preferably to chain alkyl group.

Preferable aryl groups expressed by $R^{21}$ or $R^{22}$ in the general formula (2) refer to monocyclic or condensed cyclic ones with a carbon number of 6 to 30, and more preferably monocyclic or condensed cyclic one with a carbon number of 6 to 20, which can be exemplified as phenyl and naphthyl, where phenyl being more preferable. Aryl groups expressed by $R^{21}$ or $R^{22}$ may have substituents, where the substituents include, except for those enumerated as the substituents for the aliphatic hydrocarbons expressed by $R^{21}$ or $R^{22}$, alkyl group (preferably with a carbon number of 1 to 20, more preferably 1 to 12, and still more preferably 1 to 8, exemplified as methyl, ethyl, isopropyl, tert-butyl, n-octyl, tert-amyl and cyclohexyl); alkenyl (preferably with a carbon number of 2 to 20, more preferably 2 to 12, and still more preferably 2 to 8, exemplified as vinyl, allyl, 2-butenyl and 3-pentenyl); and alkynyl group (preferably with a carbon number of 2 to 20, more preferably 2 to 12, and still more preferably 2 to 8, exemplified as propargyl, 3-pentinyl).

Favorable substituents for the aryl group expressed by $R^{21}$ or $R^{22}$ in the general formula (2) include alkyl group, aryl group, alkoxy group, aryloxy group, acyl group, alkoxycarbonyl group, acyloxy group, acylamino group, alkoxycarbonylamino group, aryloxycarbonylamino group, sulfonylamino group, sulfamoylamino group, carbamoylamino group, ureide group, alkylthio group, arylthio group, sulfonyl group, sulfinyl group, sulfonylthio group, thiosulfonyl group, phosphoric acid amide group, halogen atom, cyano group and heterocyclic group; among those more preferable are alkyl group, alkoxy group, aryloxy group, acyl group, alkoxycarbonyl group, acyloxy group, acylamino group, alkoxycarbonylamino group, aryloxycarbonylamino group, sulfonylamino group, carbamoyl group, ureide group, alkylthio group, arylthio group, sulfonyl group, sulfinyl group, phosphoric acid amide group and heterocyclic group; and still more preferable are alkyl group, alkoxy group, aryloxy group, acylamino group, sulfonylamino group, sulfamoyl group, carbamoyl group, ureide group, phosphoric acid amide group and heterocyclic group; and most preferable are alkyl group, alkoxy group, aryloxy group, acylamino group, sulfonylamino group, sulfamoyl group, carbamoyl group and ureide group.

A carbon number of the alkoxycarbonyl group expressed by $R^{21}$ or $R^{22}$ in the general formula (2) is preferably 2 to 20, more preferably 2 to 16 and still more preferably 2 to 12. Methoxycarbonyl and ethoxycarbonyl are exemplified.

A carbon number of the aryloxycarbonyl group expressed by $R^{21}$ or $R^{22}$ is preferably 7 to 20, more preferably 7 to 16 and still more preferably 7 to 10. Phenyloxycarbonyl is exemplified.

The heterocyclic group expressed by $R^{21}$ or $R^{22}$ preferably comprises a three- to ten-membered, saturated or unsaturated hetero ring containing at least one hetero atoms selected from N, O and S; the group may be monocyclic or may form a condensed ring together with other rings. The heterocyclic group preferably comprises a five- or six-membered herero ring containing a nitrogen atomr and more preferably a five- or six-membered aromatic ring containing 1 to 4 hetero atoms.

Typical examples of the heterocyclic group include ethynyl, furyl, pyranyl, 2H-pyrrolyl, pyrrolyl, imidazolyl, pyrazolyl, isothiazolyl, isooxazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolizinyl, isoindolizinyl, 3H-indolyl, indolyl, 1H-indazolyl, purinyl, 4H-quinolizinyl, isoquinolyl, quinolyl, phthalazinyl, naphthylizinyl, quinoxalinyl, quinazolinyl, cinnolinyl, pteridinyl, carbazolyl, β-carbonylyl, phenantholydinyl, acridinyl, pyrimidinyl, phenanthrolinyl, phenazinyl, phenarazinyl, phenothiazinyl, furazanyl, phenoxazinyl, isochromanyl, chromanyl, pyrrolidinyl, pyrrolinyl, imidazolidinyl, imidazolinyl, pyrazolidinyl, pyrazolinyl, piperidinyl, piperadinyl, indolinyl, isoindolinyl, quinuclidinyl, morpholinyl, tetrazolyl, benzimidazolyl, benzoxazolyl, benzthiazolyl, benztriazolyl, triazinyl, uracilyl and triazopyrimidinyl.

More preferable heterocyclic groups include pyrrolyl, imidazolyl, pyrazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolyl, 1H-indazolyl, purinyl, 4H-quinolizinyl, isoquinolyl, quinolyl, phthalazinyl, naphthylizinyl, quinoxalinyl, quinazolinyl, cinnolinyl, pteridinyl, tetrazolyl, benzimidazolyl, benzoxazolyl, benzthiazolyl, benztriazolyl, triazinyl, uracilyl and triazopyrimidinyl.

Still more preferable heterocyclic groups include imidazolyl, pyrazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolyl, 1H-indazolyl, purinyl, quinolyl, phthalazinyl, naphthylizinyl, quinoxalinyl, quinazolinyl, cinnolinyl, pteridinyl, tetrazolyl, benzimidazolyl, benzoxazolyl, benzthiazolyl, benztriazolyl, triazinyl, uracilyl and triazopyrimidinyl.

Most preferable heterocyclic groups include imidazolyl, thiazolyl, oxazolyl, 1,2,3-triazolyl, 1,2,4-triazolyl, 1,3,4-oxadiazolyl, 1,3,4-thiadiazolyl, pyridyl, quinolyl, tetrazolyl, benzimidazolyl, benzoxazolyl, benzthiazolyl, benztriazolyl, triazinyl, uracilyl and triazopyrimidinyl.

The heterocyclic groups expressed by $R^{21}$ or $R^{22}$ in the general formula (2) may have substituents, where the substituents include, except for those enumerated as the substituents for the aliphatic hydrocarbons expressed by $R^{21}$ or $R^{22}$, alkyl group (preferably with a carbon number of 1 to 20, more preferably 1 to 12, and still more preferably 1 to 8, exemplified as methyl, ethyl, isopropyl, tert-butyl, n-octyl, tert-amyl and cyclohexyl); alkenyl (preferably with a carbon number of 2 to 20, more preferably 2 to 12, and still more preferably 2 to 8, exemplified as vinyl, allyl, 2-butenyl and 3-pentenyl); and alkynyl group (preferably with a carbon number of 2 to 20, more preferably 2 to 12, and still more preferably 2 to 8, exemplified as propargyl, 3-pentinyl).

Favorable substituents for the heterocyclic group expressed by $R^{21}$ or $R^{22}$ in the general formula (2) include alkyl group, aryl group, alkoxy group, aryloxy group, acyl group, acyl oxy group, alkoxycarbonyl group, acyloxy group, acylamino group, sulfonylamino group, sulfamoyl group, sulfamoylamino group, carbamoyl group, ureide group, phosphoric acid amide group, alkylthio group, arylthio group, sulfonyl group, sulfonylthio group, sulfinyl group, sulfonylthio group, halogen atom, cyano group, nitro group and heterocyclic group; among those more preferable are alkyl group, aryl group, alkoxy group, acyl group, aryloxy group, alkoxycarbonyl group, acyloxy group, acylamino group, sulfonylamino group, sulfamoyl group, sulfonylthio group, carbamoyl group, ureide group, phosphoric acid amide group and heterocyclic group; still more preferable are alkyl group, aryl group, alkoxy group, acyl group, aryloxy group, acylamino group, sulfonylamino group, sulfamoylamino group, sulfonylthio group, carbamoyl group, ureide group, phosphoric acid amide group, sulfonylthio group and heterocyclic group; and most preferable are alkyl group, alkoxy group, aryloxy group, acylamino group, sulfonylamino group, sulfamoyl group, sulfonylthio group, carbamoyl group, ureide group and heterocyclic group.

It is preferable that at least either one of $R^{21}$ or $R^{22}$ is a heterocyclic group, where $R^{21}$ is more preferable.

Most preferable compounds expressed by the general formula (2) include such compounds in which $R^{21}$ is a heterocyclic group, and $R^{22}$ is an alkyl group, aryl group or heterocyclic group, all of which may be substituted.

Still more preferable compounds expressed by the general formula (2) are such compounds in which $R^{21}$ is a heterocyclic group having a formula (4) below:

(4)

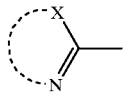

and $R^{22}$ is an alkyl group, aryl group or heterocyclic group, all of which may be substituted.

In the general formula (4), X represents an atomic group required for forming a five- or six-membered hetero ring, where the hetero ring may be monocyclic or may form a condensed ring together with other rings. The heterocyclic group of the formula (4) may have further substituents. As these substituents, employable are those enumerated above as the substituents for the case that $R^{21}$ or $R^{22}$ in the general formula (2) is a heterocyclic group. Favorable cyclic group include, for example, imidazolyl group, pyridinyl group, quinolyl group, thiazolyl group, oxazolyl group, thiadiazolyl group, triazolyl group, tetrazolyl group, benzimidazolyl group, benzthiazolyl group and benzoxazolyl group.

Typical examples of the compounds expressed by the general formula (2) are shown below, while not particularly being limited thereto.

I-1

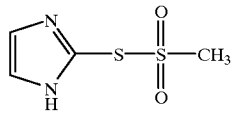

I-2

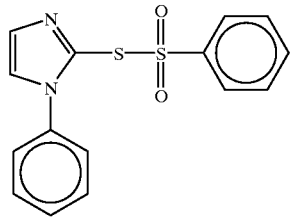

I-3

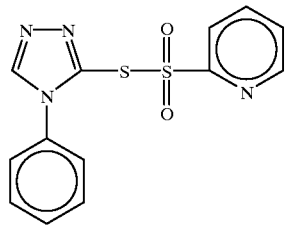

I-4

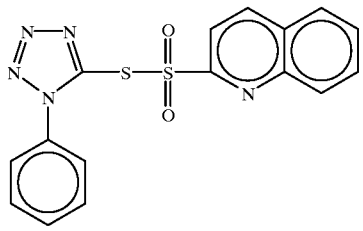

-continued
I-5
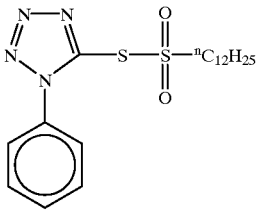
I-6
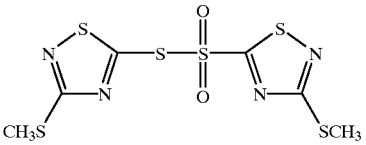
I-7
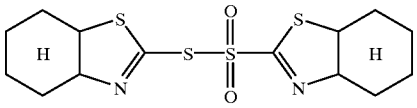
I-8
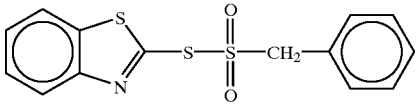
I-9
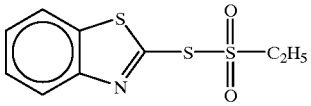
I-10
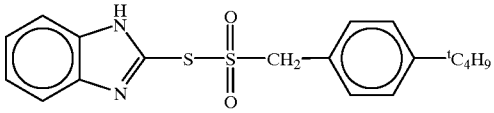
I-11
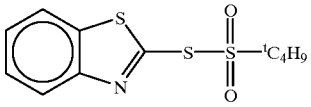
I-12
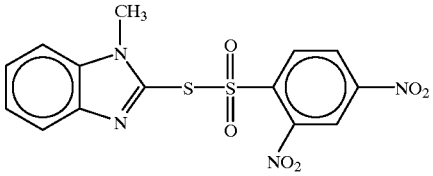
I-13
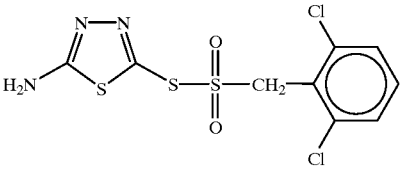
I-14
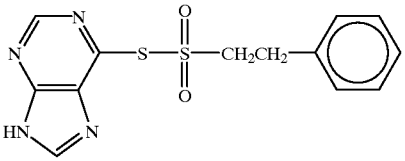
-continued
I-15
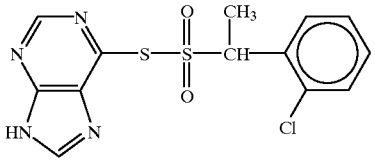
I-16
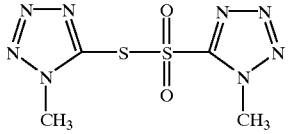
I-17
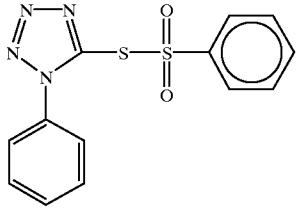
I-18
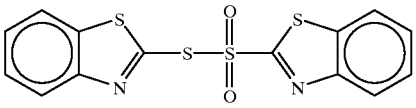
I-19
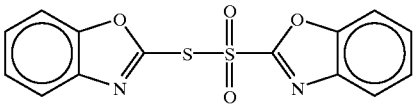
I-20
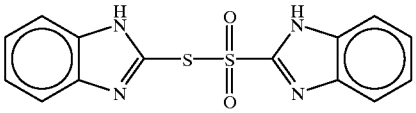
I-21
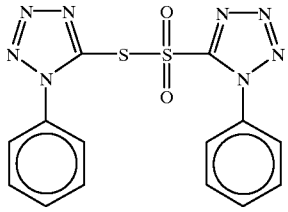
I-22
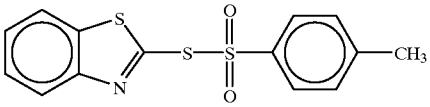
I-23
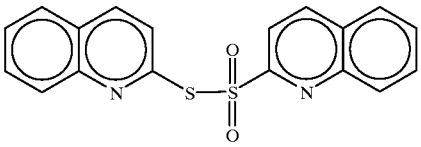
I-24
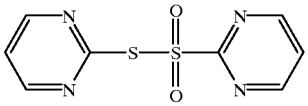

-continued
I-25
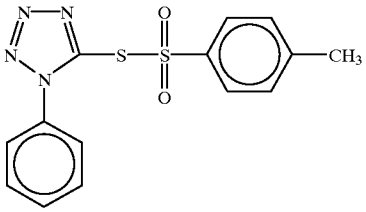
I-26
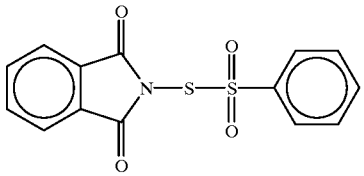
I-27
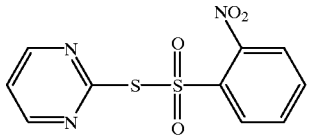
I-28
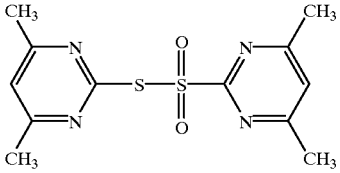
I-29
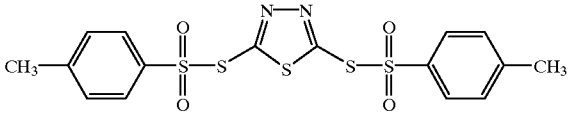
I-30
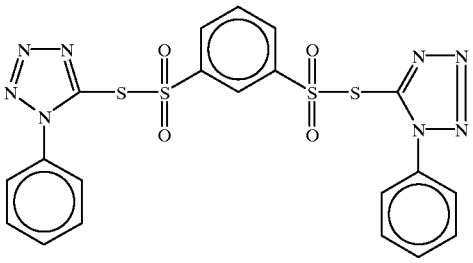
I-31
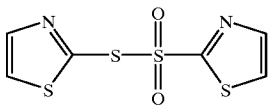
I-32
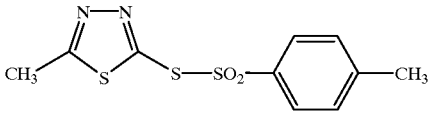
-continued
I-33
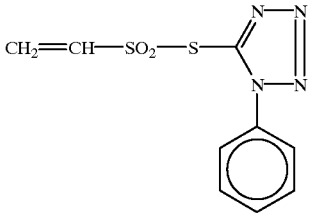
I-34
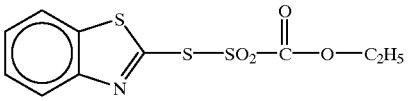
I-35
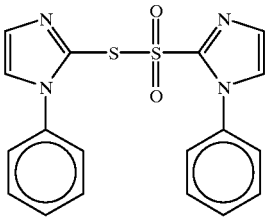
I-36
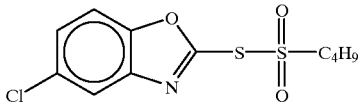
I-37
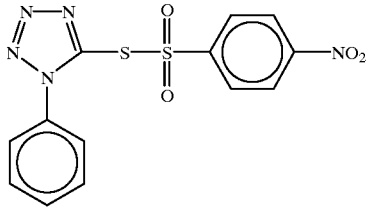
I-38
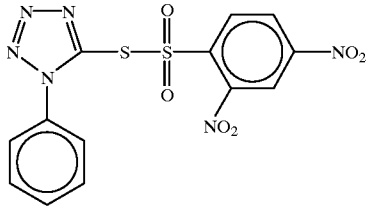
I-39
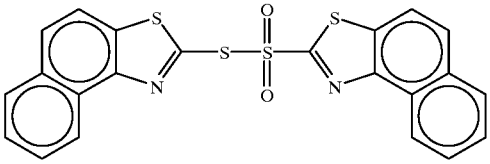

-continued

I-40

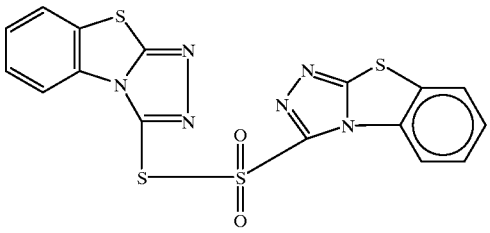

I-41

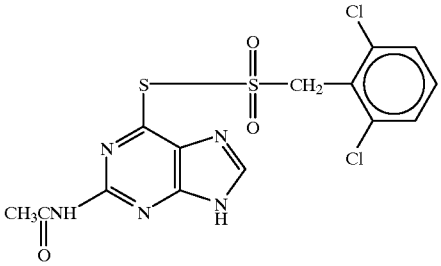

I-42

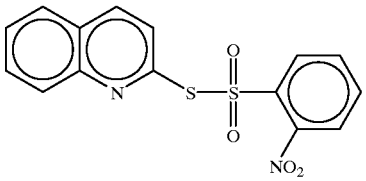

I-43

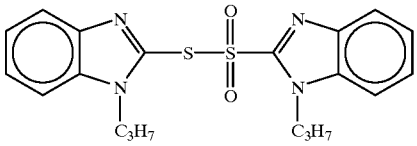

I-44

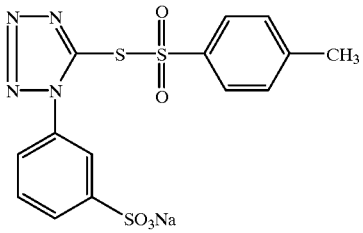

I-45

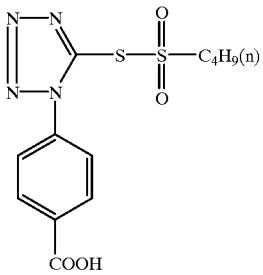

-continued

I-46

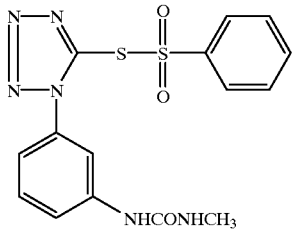

I-47

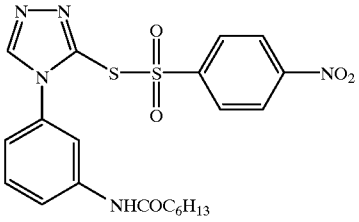

I-48

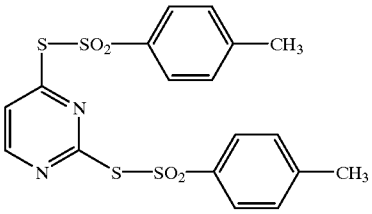

I-49

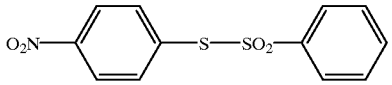

I-50

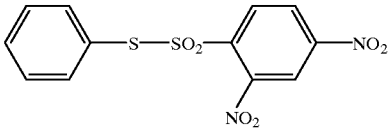

The compounds of the general formula (2) used in the present invention can commercially be available or may be synthesized the methods according to the description in "Shin-Jikken Kagaku Koza (New Course for Experimental Chemistry)", Vol. 14, p.1801–1803 (Ed. by The Chemical Society of Japan) in relation to disproportionation of sulfinic acid, oxidation of disulfide, reaction of sulfonyl halide with thiolate, reaction of disulfide with sulfinic acid salt, reaction of sulfinic acid salt with sulfenyl halide, etc.

The compounds expressed by the general formula (2) can be used in the present invention as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The compounds can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid of a ball mill, colloid mill, sand grinder mill, manthonegalling, micro-fluidizer or ultrasonic wave.

In the present invention, the compounds of the general formula (2) are preferably used in an amount, as expressed by a molar amount per 1 mole of silver, from $1\times10^{-5}$ to $5\times10^{-1}$ mol/mol Ag, and more preferably from $5\times10^{-5}$ to $1\times10^{-1}$ mol/mol Ag, and still more preferably from $1\times10^{-4}$ to $5\times10^{-2}$ mol/mol Ag.

Next paragraphs will describe the ultrahigh contrast agent used in the present invention. The ultrahigh contrast agents can be selected from various known compounds, which include hydrazines disclosed in, for example, U.S. Pat. No. 5,464,738, U.S. Pat. No. 5,496,695, U.S. Pat. No. 5,512,411, and U.S. Pat. No. 5,536,622, JP-B-6-77138 and JP-B-6-93082 (the code "JP-B" as used herein means an "examined Japanese patent publication"), JP-A-6-230497, JP-A-6-289520, JP-A-6-313951, JP-A-7-5610, JP-A-7-77783 and JP-A-7-104426; acrylonitrile derivatives disclosed in U.S. Pat. Nos. 5,545,515 and 5,635,339; malondialdehydes disclosed in U.S. Pat. No. 5,654,130; and isoxazoles disclosed in U.S. Pat. No. 5,705,024. Known development accelerators include amine compounds disclosed in U.S. Pat. No. 5,545,505; hydroxamic acids disclosed in U.S. Pat. No. 5,545,507; and hydrogen atom donors disclosed in U.S. Pat. No. 5,637,449. All these known materials are available for the present invention. More preferable ultrahigh contrast agents relate to a substituted alkene derivative, substituted isooxazole derivative and acetal derivative respectively expressed by the general formulae (11), (12) and (13) below:

(11)

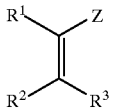

(12)

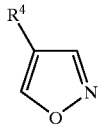

(13)

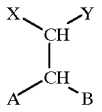

In the general formula (11), $R^1$, $R^2$ and $R^3$ independently represent a hydrogen atom or substituent, and Z represents an electron attracting group. In the general formula (11), $R^1$ as bound with Z; $R^2$ as bound with $R^3$; $R^1$ as bound with $R^2$; or $R^3$ as bound with Z may form a cyclic structure. In the general formula (12), $R^4$ represents a substituent. In the general formula (13), X and Y independently represent a hydrogen atom or substituent; A and B independently represent alkoxy group, alkylthio group, alkylamino group, aryloxy group, arylthio group, anilino grouup, heterocyclic oxy group, heterocyclic thio group or heterocyclic amino group. In the general formula (13), X as bound with Y, and A as bound with B, may form a cyclic structure.

In the general formula (11), possible examples for $R^1$, $R^2$ and $R^3$ include halogen atom (fluorine atom, chlorine atom, bromine atom or iodine atom), alkyl group (including aralkyl group, cycloalkyl group and active methine group), alkenyl group, alkynyl group, aryl group, heterocyclic group (including N-substituted nitrogen-containing heterocyclic group), heterocyclic group containing a quaternized nitrogen atom (e.g. pyridinio group), acyl group, alkoxycarbonyl group, aryloxycarbonyl group, carbamoyl group, carboxyl group or salt thereof, imino group, imino group substituted by nitrogen atom, thiocarbonyl group, sulfonylcarbamoyl group, acylcarbamoyl group, sulfamoylcarbamoyl group, carbazolyl group, oxalyl group, oxamoyl group, cyano group, thiocarbamoyl group, hydroxyl group, alkoxy group (including a group containing repetitive units of ethylenoxy group or propylenoxy group), aryloxy group, heterocyclic oxy group, acyloxy group, (alkoxy or aryloxy)carbonyloxy group, carbamoyloxy group, sulfonyloxy group, amino group, (alkyl, aryl or heterocyclic)amino group, acylamino group, sulfonamide group, ureide group, thioureide group, isothioureide group, imide group, (alkoxy or aryloxy) carbonylamino group, sulfamoylamino group, semicarbazide group, thiosemicarbazide group, hydrazino group, quaternized ammonio group, oxamoylamino group, (alkyl or aryl)sulfonylureide group, acylureide group, acylsulfamoylamino group, nitro group, mercapto group, (alkyl, aryl or heterocyclic)thio group, acylthio group, (alkyl or aryl) sulfonyl group, (alkyl or aryl)sulfinyl group,sulfo group or salt thereof, phosphoryl group, group containing phosphate amide or phosphate ester structure, silyl group and stannyl group. These substituents may further be substituted by these substituents.

The electron attracting group represented by Z in the general formula (11) is such substituent having a positive Hammett's substituent constant $\sigma_p$, which is typified as cyano group, alkoxycarbonyl group, aryloxycarbonyl group, carbamoyl group, imino group, imino group substituted by nitrogen atom, thiocarbonyl group, sulfamoyl group, alkylsulfonyl group, arylsulfonyl group, nitro group, halogen atom, perfluoroalkyl group, perfluoroalkanamide group, sulfonamide group, acyl group, formyl group, phosphoryl group, group, sulfo group (or salt thereof), heterocyclic group, alkenyl group, alkynyl group, acyloxy group, acylthio group, sulfonyloxy group, or aryl group substituted by these electron attracting groups. Here, the heterocyclic group is defined as aromatic or non-aromatic, saturated or unsaturated heterocyclic group, which is typified as pyridyl group, quinolyl group, pyradinyl group, benzotriazolyl group, imidazolyl group, benzimidazolyl group, hydantoin-1-yl group, urazole-1-yl group, succinimido group and phthalimido group. The electron attracting group expressed by Z in the general formula (11) may further have arbitrary substituent.

The electron attracting group represented by Z in the formula (11) is preferably such that having a total carbon number of 0 to 30, which is typified as cyano group, alkoxycarbonyl group, aryloxycarbonyl group, carbamoyl group, thiocarbonyl group, imino group, imino group substituted by nitrogen atom, sulfamoyl group, alkylsulfonyl group, arylsulfonylgroup, nitro group, perfluoroalkyl group, acyl group, formyl group, phosphoryl group, acyloxy group, acylthio group or phenyl group substituted by arbitrary electron attracting group. Among these more preferable are cyano group, alkoxycarbonyl group, carbamoyl group, thiocarbonyl group, imino group, imino group substituted by nitrogen atom, sulfamoyl group, alkylsulfonyl group, arylsulfonyl group, acyl group, formyl group, phosphoryl group, trifluoromethyl group or a phenyl group substituted by arbitrary electron attracting group; and still more preferably are cyano group, alkoxycarbonyl group, carbamoyl group, imino group, imino group substituted by nitrogen atom, alkylsulfonyl group, arylsulfonyl group, acyl group and formyl group.

The substituent represented by $R^1$ in the general formula (11) is preferably a group having a total carbon number of 0 to 30, which is exemplified as a group based on the same definition as the above-described electron attracting group represented by Z in the general formula (11), as well as alkyl group, alkenyl group, alkoxy group, aryloxy group, heterocyclic oxy group, alkylthio group, arylthio group, heterocyclic thio group, amino group, alkylamino group, arylamino group, heterocyclic amino group, ureide group, acylamino group, silyl group, or substituted or unsubstituted aryl group. Among these, more preferable are a group based on the same definition as the above-described electron attracting group represented by Z in the general formula (11), as well as substituted or unsubstituted aryl group, alkenyl group, alkylthio group, arylthio group, alkoxy group, silyl group and acylamino group; and still more preferable are electron attracting group, aryl group, alkenyl group and acylamino group.

When $R^1$ represents an electron attracting group, preferable range thereof is the same with that for the electron attracting group represented by Z.

The substituent represented by $R^2$ or $R^3$ in the general formula (11) is preferably a group based on the same definition as the above-described electron attracting group represented by Z in the general formula (11), as well as alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, anilino group, heterocyclic amino group, acylamino group, and substituted or unsubstituted phenyl group. It is more preferable that either $R^2$ or $R^3$ represents a hydrogen atom and the other represents a substituent. Such substituent is preferably an alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, anilino group, heterocyclic amino group, acylamino group (more specifically, perfluoroalkaneamide group), sulfoneamide group, substituted or unsubstituted phenyl group or heterocyclic group. Still more preferable are hydroxyl group (or salt thereof), mercapto group (or salt thereof), alkoxy group, aryloxy group, heterocyclic oxy group, alkylthio group, arylthio group, heterocyclic thio group, amino group, and heterocyclic group; and most preferable are hydroxyl group (or salt thereof), alkoxy group and heterocyclic group.

It is also preferable that Z as bound with $R^1$; or $R^2$ as bound with $R^3$ in the general formula (11) may form a cyclic structure. The cyclic structure thus formed is an aromatic or non-aromatic heterocycle, preferably having a five- to seven-membered cyclic structure, preferably having a total carbon number of 1 to 40, and more preferably 3 to 35.

Among the compounds expressed by the general formula (11), one more preferable example is a compound in which Z represents any one of cyano group, formyl group, acyl group, alkoxycarbonyl group, imino group and carbamoyl group; $R^1$ represents an electron attracting group; either $R^2$ or $R^3$ represents a hydrogen atom and the other represents any one of hydroxyl group (or salt thereof), mercapto group (or salt thereof), alkoxy group, aryloxy group, heterocyclic oxy group, alkylthio group, arylthio group, heterocyclic thio group, amino group and heterocyclic group.

Among the compounds expressed by the general formula (11), another more preferable example is a compound in which Z and $R^1$ bind with each other to form a non-aromatic five- to seven-membered ring structure; either $R^2$ or $R^3$ represents a hydrogen atom and the other represents any one of hydroxyl group (or salt thereof), mercapto group (or salt thereof), alkoxy group, aryloxy group, heterocyclic oxy group, alkylthio group, arylthio group, heterocyclic thio group, amino group and heterocyclic group.

The non-aromatic five- to seven-membered ring formed by Z and $R^1$ is specificallyindane-1,3-dione ring; pyrrolidine-2,4-dione ring; pyrazolidine-3,5-dion ring; oxazolidine-2,4-dione ring; 5-pyrazolone ring; imidazolidine-2,4-dione ring; thiazolidine-2,4-dione ring; oxolan-2,4-dione ring; thiolan-2,4-dione ring; 1,3-dioxane-4,6-dione ring, cyclohexane-1,3-dione ring; 1,2,3,4-tetrahydroquinoline-2,4-dione ring, cyclopentane-1,3-dione ring; isooxazolidine-3,5-dione ring; barbituric acid ring; 2,3-dihydrobenzofuran-3-one ring; pyrazolotriazole ring (e.g. 7H-pyrazolo[1,5-b][1,2,4]triazole, 7H-pyrazolo[5,1-c][1,2,4]triazole, 7H-pyrazolo[1,5-a]benzimidazole); pyrrolotriazole ring (e.g. 5H-pyrrolo[1,2-b][1,2,4]triazole, 5H-pyrrolo[2,1-c][1,2,4]triazole); 2-cyclopentene-1,3-dione ring; 2,3-dihydrobenzothiophene-3-one-1,1-dioxide ring; chroman-2,4-dione ring; or oxazoline-5-one ring. Among these more preferable are indane-1,3-dione ring; pyrrolidine-2,4-dione ring; pyrazolidine-3,5-dion ring; 5-pyrazolone ring; barbituric acid ring; and oxazoline-5-one ring.

The substituents expressed by $R^4$ in the general formula (12) can be exemplified as those described for $R^1$ to $R^3$ in the general formula (11).

The substituents expressed by $R^4$ in the general formula (12) is preferably an electron attracting group or aryl group. When $R^4$ represents an electron attracting group, a total carbon number of which is preferably 0 to 30, which can be exemplified as cyano group, nitro group, acyl group, formyl group, alkoxycarbonyl group, aryloxycarbonyl group, alkylsulfonyl group, arylsulfonyl group, carbamoyl group, sulfamoyl group, perfluoroalkyl group, phosphoryl group, imino group, sulfonamide group and heterocyclic group. Among these, more preferable are cyano group, acyl group, formyl group, alkoxycarbonyl group, carbamoyl group, sulfamoyl group, alkylsulfonyl group, arylsulfonyl group, sulfonamide group and heterocyclic group.

When $R^4$ represents an aryl group, it is preferably a substituted or unsubstituted phenyl group with a total carbon number of 0 to 30, the substituent of which can be exemplified as those described for $R^1$, $R^2$ and $R^3$ in the general formula (11) for the case that $R^1$, $R^2$ and $R^3$represent the substituents. Among which, an electron attracting group is preferable.

The substituents expressed by X and Y in the general formula (13) can be exemplified as those described for $R^1$ to $R^3$. The substituents expressed by X and Y in the general formula (13) preferably have an total carbon number of 1 to 50, and more preferably 1 to 35, which are exemplified as cyano group, alkoxycarbonyl group, aryloxycarbonyl group, carbamoyl group, imino group, imino group substituted by nitrogen atom, thiocarbonyl group, sulfamoyl group, alkylsulfonyl group, arylsulfonyl group, nitro group, perfluoroalkyl group, acyl group, formyl group, phosphoryl group, acylamino group, acyloxy group, acylthio group, heterocyclic group, alkylthio group, alkoxy group and aryl group. Among these, more preferable are cyano group, nitro group, alkoxycarbonyl group, carbamoyl group, acyl group, formyl group, acylthio group, acylamino group, thiocarbonyl group, sulfamoyl group, alkylsulfonyl group, arylsulfonyl group, imino group, imino group substituted by nitrogen atom, phosphoryl group, trifluoromethyl group, heterocyclic group and substituted phenyl group. Still more preferable are cyano group, alkoxycarbonyl group, carbamoyl group, alkylsulfonyl group, arylsulfonyl group, acyl group, acylthio group, acylamino group, thiocarbonyl group, formyl group, imino group, imino group substituted by nitrogen atom, heterocyclic group and phenyl group substituted by arbitrary substituent.

It is also preferable that X and Y mutually bind to form a non-aromatic carbon ring or non-aromatic hetero ring. The rings thus formed are preferably of five- to seven-membered, which can specifically be exemplified as the non-aromatic five- to seven-membered ring generated by the mutual binding between Z and $R^1$ in the general formula (11), preferable range of which being the same. These rings may also have further substituent and may have a total carbon number of 1 to 40, and more preferably 1 to 35.

The substituents expressed by A and B in the general formula (13) may also have further substituent and may have a total carbon number of 1 to 40, and more preferably 1 to 30.

A more preferable case relates to that A and B in the general formula (13) bind with each other to form a cyclic structure. The cyclic structure thus obtained is preferably a five- to seven-membered non-aromatic hetero ring with a total carbon number of 1 to 40, and more preferably 3 to 30. The bound structures between A and B include, for example, —O—$(CH_2)_2$—O—, —O—$(CH_2)_3$—O—, —S—$(CH_2)_2$—S—, —S—$(CH_2)_3$—S—, —S—Ph—S—, —N$(CH_3)$—$(CH_2)_2$—O—, —O—$(CH_2)_3$—S—, —N$(CH_3)$—Ph—S— and —N(Ph)—$(CH_2)_2$—S—.

The compounds expressed by the general formulae (11) to (13) used in the present invention may be incorporated with an adsorptive group capable of adsorbing silver halide. Such group may be a ballast group or polymer commonly used in immobile photographic additives such as a coupler; cationic group (e.g. a group containing quaternary ammonio group, or nitrogen-containing hetero ring containing a quaternized nitrogen atom); a group containing repetitive units of ethyleneoxy group or propyleneoxy group; (alkyl, aryl or heterocyclic) thio group; or dissociative group capable of dissociating under the presence of base (e.g. carboxyl group, sulfo group, acylsulfamoyl group, carbamoylsulfamoyl group). Examples of these groups are disclosed in JP-A-63-29751, U.S. Pat. Nos. 4,385,108 and 4,459,347, JPA-59-195233, JPA-59-200231, JPA-59-201045, JP-A-59-201046, JPA-59-201047, JPA-59-201048, JPA-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-7-234471, JPA-9-333466, JP-A-6-19032, JP-A-6-19031, JPA-9-45761, U.S. Pat. Nos. 4,994,365 and 4,988,604, JP-A-7-259240, JP-A-7-5610, JP-A-7-244348 and German Patent No. 4,006,032.

The compounds particularly useful as ultrahigh contrast agent used in the present invention refer to the substituted alkene derivatives expressed by the general formula (11). Among these, most preferable are such compounds in which Z and $R^1$ in the general formula (11) bind with each other to form a five- to seven-membered cyclic structure; either $R^2$ or $R^3$ represents a hydrogen atom; and the other represents hydroxyl group (or salt thereof), mercapto group (or salt thereof), alkoxy group, aryloxy group, heterocyclic oxy group, alkylthio group, arylthio group, heterocyclic thio group, amino group or heterocyclic group.

Typical examples of the compounds expressed by the general formulae (11) to (13) used in the present invention are listed below, while not particularly being limited thereto:

1

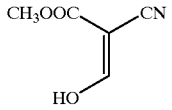

-continued

2

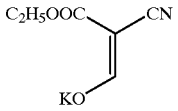

3

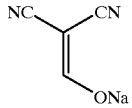

4

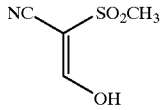

5

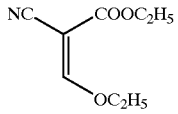

6

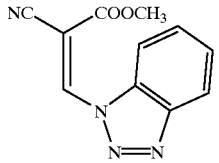

7

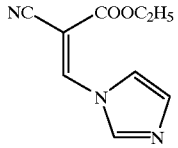

8

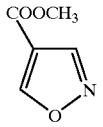

9

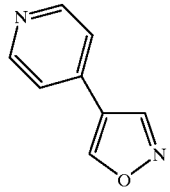

10

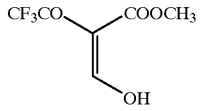

11

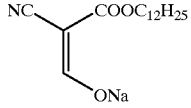

-continued
12
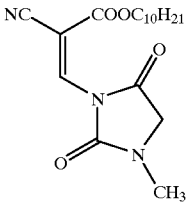
13
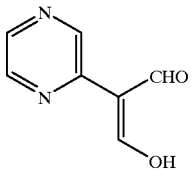
14
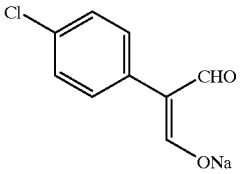
15
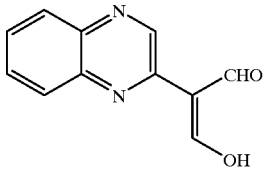
16
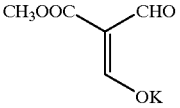
17
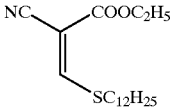
18
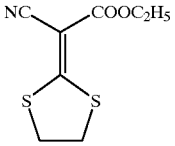
19
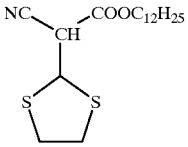
20
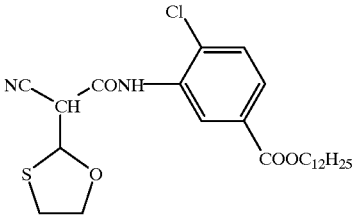
-continued
21
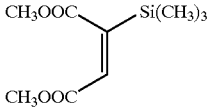
22
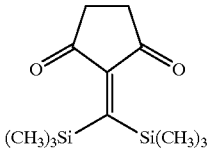
23
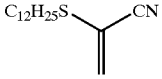
24
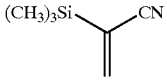
25
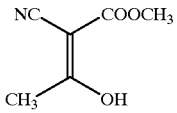
26
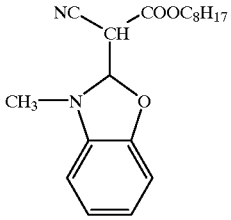
27
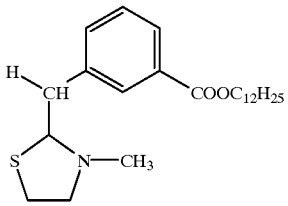
28
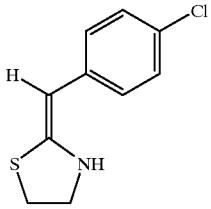
29
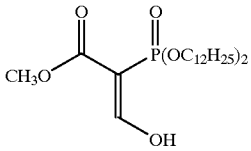
30
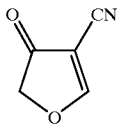

-continued
31
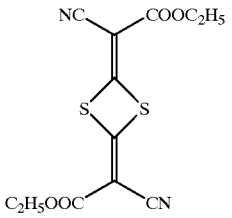
32
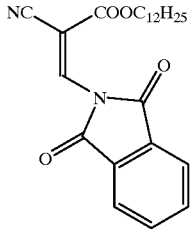
33
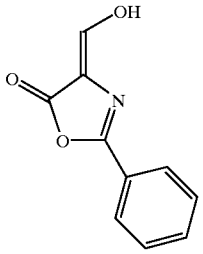
34
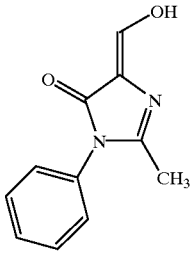
35
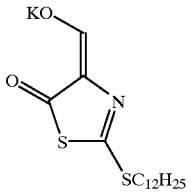
36
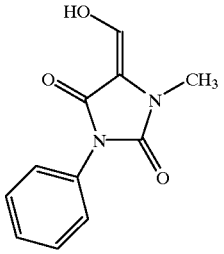
-continued
37
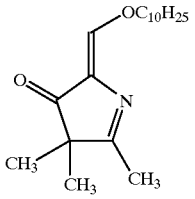
38
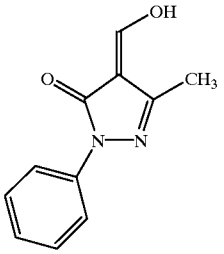
39
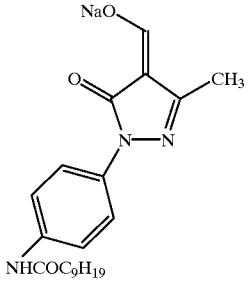
40
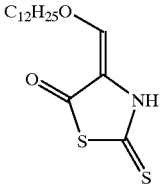
41
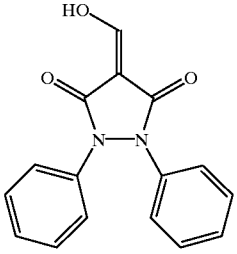
42
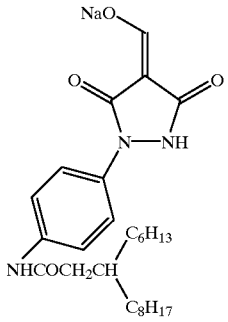

-continued
43
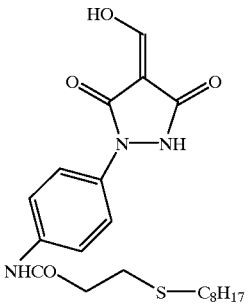
44
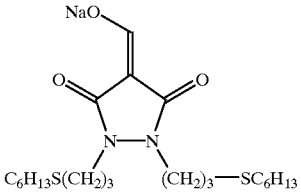
45
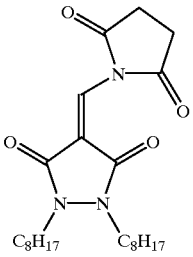
46
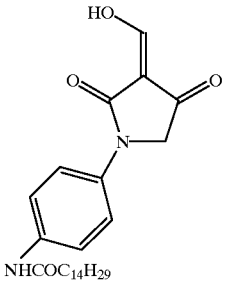
47
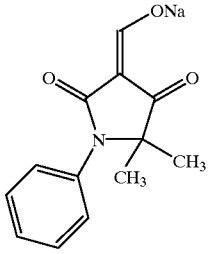
48
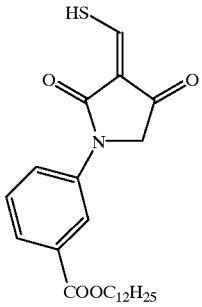
-continued
49
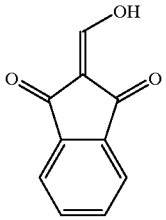
50
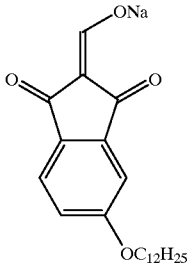
51
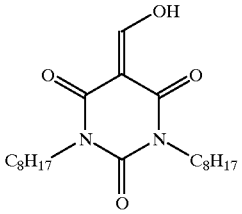
52
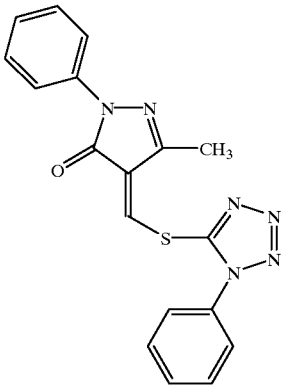
53
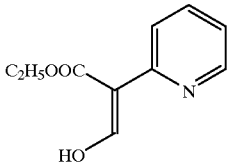
54
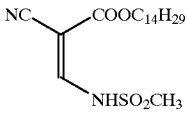

-continued
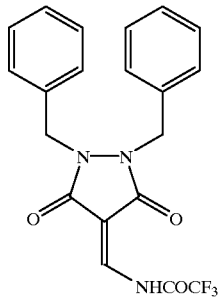
56
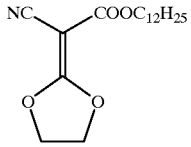
57
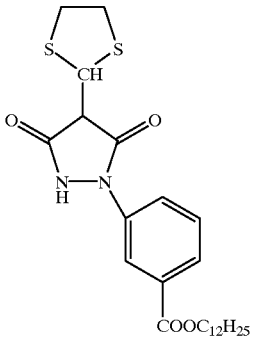
58
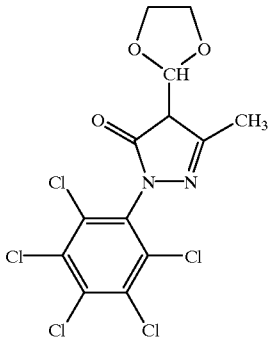
59
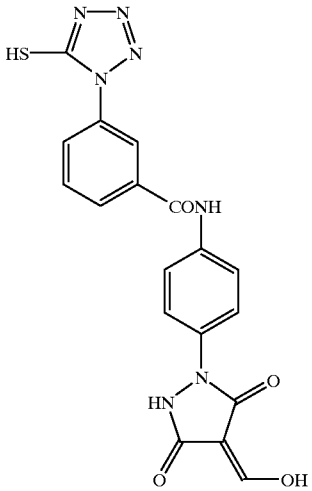
-continued
60
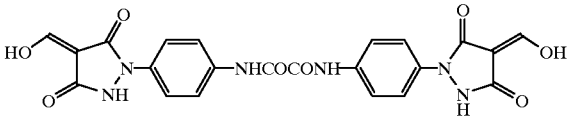
61
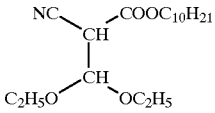
62
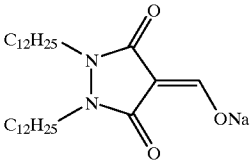
63
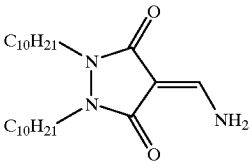
64
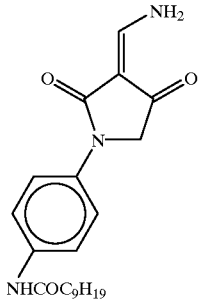
65
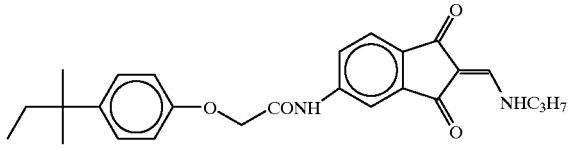
66
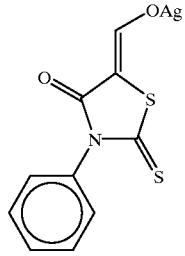
67
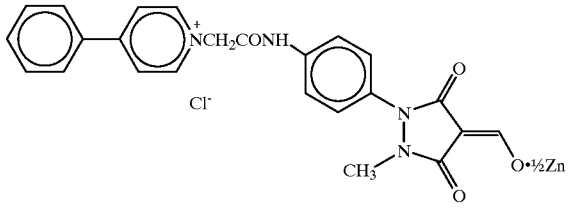

-continued

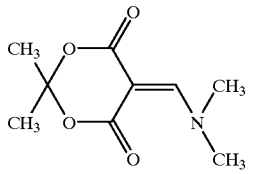

68

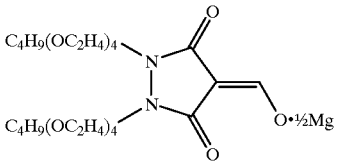

69

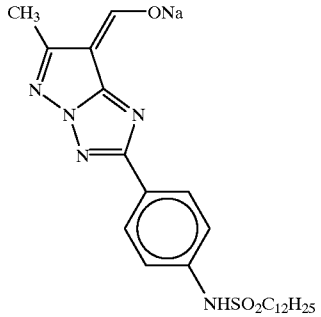

70

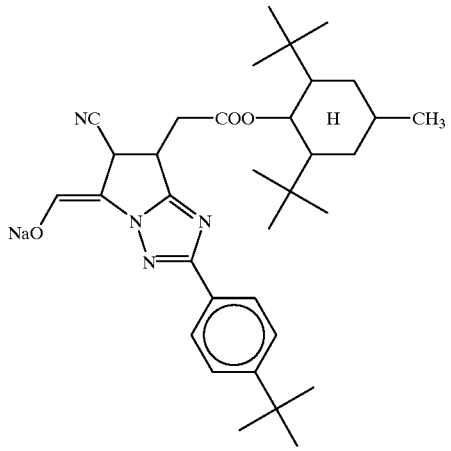

71

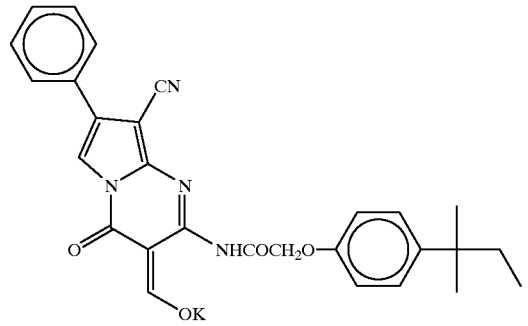

72

The compounds expressed by the general formulae (11) to (13) can easily be synthesized according to known methods referring, for example, to U.S. Pat. No. 5,635,339, U.S. Pat. No. 5,654,130, International Patent Publication WO 97/34196 or JP-A-9-354107, JP-A-9-309813 and JP-A-9-272002.

The compounds represented by the general formulae (11) to (13) may be used individually or in combination of two or more thereof. In addition to these compounds, compounds described in U.S. Pat. No. 5,545,515, U.S. Pat. No. 5,635,339, U.S. Pat. No. 5,654,130, U.S. Pat. No. 5,705,324 and No.5,686,228, JP-A-10-161270, JP-A-9-273935, JP-A-9-354107, JP-A-9-309813, JP-A-9-296174, JP-A-9-282564, JP-A-9-272002, JP-A-9–272003 and JP-A-9-332388 may also be used in combination.

In the present invention, various hydrazine derivatives disclosed in JP-A-10-161270 can also be used in combination.

The compounds expressed by the formulae (11) to (13) can be used in the present invention as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The compounds can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid of a ball mill, colloid mill or ultrasonic wave.

The compounds of the general formulae (11) to (13) used in the present invention can be added to any layer provided on the side of the image-forming layer as viewed from a support, where addition to the image-forming layer or to the layer adjacent thereto is preferable.

In the present invention, the compounds of the general formulae (11) to (13) are preferably used in an amount, as expressed by a molar amount per 1 mole of silver, from $1\times10^{-6}$ to 1 mol, and more preferably from $1\times10^{-5}$ to $1\times10^{-1}$ mol, and still more preferably from $2\times10^{-5}$ to $2\times10^{-1}$ mol.

Next, the reducing agent used in the present invention will be described.

The heat-developable photosensitive material of the present invention contains the reducing agent for reducing the organic silver salt. The reducing agent used in the present invention may be arbitrary substance capable of reducing silver ion into metal silver, and preferably an organic substance. While conventional photographic developers such as phenidone, hydroquinone and catechol are useful, a hindered phenol reducing agent is preferred. The reducing agent is preferably contained in an amount of from 5 to 50 mol %, more preferably from 10 to 40 mol % per one mol of silver presents in the face where the image-forming layer is provided. A layer to which the reducing agent is added may be any layer on the surface having the image-forming layer. In the case of adding the reducing agent to a layer other than the image-forming layer, the reducing agent is preferably used in a slightly larger amount of from 10 to 50 mol % per one mol of silver. The reducing agent may also be a so-called precursor which is derived to effectively exhibit its function only at the time of development.

For heat-developable photosensitive material using an organic silver salt, a wide variety of reducing agents are known, for example, in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-

52-84727, JP-A-55-108654, JP-A-56-146133, JP-A-57-82828, JP-A-57-82829, JP-A-6-3793, U.S. Pat. No. 3,667,958, U.S. Pat. No. 3,679,426, U.S. Pat. No. 3,751,252, U.S. Pat. No. 3,751,255, U.S. Pat. No. 3,761,270, U.S. Pat. No. 3,782,949, U.S. Pat. No. 3,839,048, U.S. Pat. No. 3,928,686 and U.S. Pat. No. 5,464,738, German Patent No. 2,321,328 and European Patent No. 692,732. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid, such as a combination of 2,2'-bis(hydroxymethyl)propionyl-β-phenylhydrazine with ascorbic acid; combinations of polyhydroxybenzene with hydroxylamine, reductone and/or hydrazine (e.g. combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of azine with sulfonamidophenol such as a combination of phenothiazine with 2,6-dichloro-4-benzenesulfonamidophenol; α-cyanophenylacetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of bis-β-naphthol with 1,3-dihydroxybenzene derivative (e.g. 2,4-dihydroxybenzophenone or 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols (e.g. tocopherol). Particularly preferred reducing agents are bisphenols and chromanols.

The reducing agent used in the present invention may be added in any form of solution, powder or solid microparticle dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

More preferable reducing agents refer to those having at least one phenolic hydroxyl group, ortho position of which being substituted by a substituent other than a hydrogen atom. One or more phenol rings may exist within one molecule. Specific examples of exceptionally preferable reducing agents are those expressed by the general formulae (Ia), (Ib), (IIa), (IIb), (III), (IVa) and (IVb) in the paragraphs of [0062] to [0074] of JP-A-9-274274, which are expressed by chemical formulae [28] to [32] of that specification.

The amount of use of the reducing agents in the present invention is preferably $10^{-3}$ to 10 mol per one mol of silver, and more preferably $10^{-2}$ to 1.5 mol.

A molar ratio of the reducing agent and ultrahigh contrast agent in the present invention is preferably set between 1:10–3 to $1:10^{-1}$.

The functional layer of the heat-developable photosensitive material of the present invention employs water-dispersed thermoplastic resin as a binder, where the water-dispersed thermoplastic resin accounting for at least 50% or above of the total binder. The water-dispersed thermoplastic resin may have any form of polymer emulsified in dispersion medium, emulsion-polymerized or dispersed as micells; or the polymer can be dispersed so that its molecular chain per se disperses when the polymer has, in a part of its body, some hydrophilic structure. Such water-dispersions are generally noted as polymer latex in a broad sense. Details for the polymer latex are found, for example, in "Gosei Jushi Emulsion (Synthetic Resin Emulsion)", ed. by Taira Okuda and Hiroshi Inagaki, issued by Kobunshi Kanko Kai (1978); "Gosei Latex no O-yo (Applications of Synthetic Latex)", ed. by Takaaki Sugimura, Yasuo Kataoka, Souichi Suzuki and Keiji Kasahara, issued by Kobunshi Kanko Kai (1993); and Soichi Muroi, "Gosei Latex no Kagaku (Chemistry of Synthetic Latex)", issued by Kobunshi Kanko Kai (1970). The dispersed particles preferably have an average particle size of 1 to 50,000 nm, more preferably approx. 5 to 1,000 nm. The particle size distribution of the dispersed particles is not particularly limited, and the dispersed particles may have a broad particle size distribution or a monodisperse particle size distribution.

As the water-dispersed thermoplastic resin for use in the present invention, not only an ordinary uniform-structured polymer latex but also a so-called core/shell type latex are available. In some cases, it is preferred that the core and the shell have different glass transition temperatures.

Preferable range of the glass transition temperature (Tg) of the thermoplastic resin used as the binder in the present invention differ according to its use for the protective layer, back layer or image-forming layer. For use in the image-forming layer, the glass transition temperature is preferably 40° C. or lower, and more preferably from −30 to 40° C., so that the photographically useful material can acceleratingly disperse at the time of heat development. For use in the protective layer and back layer, a glass transition temperature of 25 to 70° C. is preferable since the layers come into contact with various kinds of equipment.

The polymer latex for use in the present invention preferably has a minimum film-forming temperature (MFT) of from −30 to 90° C., more preferably from 0 to 70° C. In order to control the MFT, a film-forming aid may be added. The film-forming aid, also called a temporary plasticizer, refers to an organic compound (usually an organic solvent) capable of lowering the MFT of the polymer latex, which is described in "Gosei Latex no Kagaku (Chemistry of Synthetic Latex)", by Souichi Muroi, issued by Kobunshi Kanko Kai (1970), supra.

The polymer species of the polymer latex for use in the present invention include acrylic resin, vinyl acetate resin, polyester resin, polyurethane resin, rubber-based resin, vinyl chloride resin, vinylidene chloride resin, polyolefin resin or copolymers thereof. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 100,000. Too small molecular weight will result in poor mechanical strength of the image-forming layer, whereas too large in degraded and undesirable film-forming property.

Specific examples of the water-dispersed thermoplastic resin (polymer latex) used in the present invention include methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, and vinylidene chloride/ethyl acrylate/acrylonitrile/methacrylic acid copolymer latex. Such polymers are also commercially available, which include acrylic resins such as CEBIAN A-4635, 46583 and 4601 (all produced by Dicel Kagaku Kogyo KK) and Nipol Lx811, 814, 821, 820, 857 (all produced by Nippon Zeon KK); polyester resins such as FINETEX ES650, 611, 675, 850 (all producedbyDai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all producedby Dai-Nippon Ink & Chemicals, Inc.), Nipol Lx416, 410, 438C and 2507 (all produced by Nippon Zeon KK); vinyl chloride resins such as G351, G576 (both produced by Nippon Zeon KK); vinylidene chloride resins such as L502, L513 (both produced by Asahi Chemical Industry Co., Ltd.), ARON D7020, D504 and D5071 (all produced by Mitsui Chemical Co., Ltd.); and olefin resins such as CHEMIPEARL S120 and SA100 (both produced by Mitsui Chemical Co., Ltd.). These polymers may be used individually or, as required, as a blend of two or more thereof.

In the functional layer of the heat-developable photosensitive material of the present invention, the polymer latex preferably accounts for 50 wt % or more of the total binder, and more preferably 70 wt % or more.

To the functional layer of the heat-developable photosensitive material of the present invention, it is allowable to add, as required, hydrophilic polymer such as gelatin, polyvinyl alcohol, methylcellulose, hydroxypropylcellulose, carboxymethylcellulose, and hydroxypropylmethylcellulose. The amount of addition of these hydrophilic polymers is preferably 30 wt % or less of the total binder of the image-forming layer, and more preferably 5 wt % or less.

It is preferable that the functional layer of the heat-developable photosensitive material of the present invention is formed by coating water-base liquid, which is followed by drying. Here, "water-base" in the context of the present invention refers to that water accounts for 60 wt % or more of the solvent (dispersion medium) of the coating liquid. Possible component other than water may be water-miscible organic solvent such as methanol, ethanol, isopropanol, Methyl Cellosolve, Ethyl Cellosolve, dimethylformaide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in wt %).

Amount of the total binder of the functional layer in the heat-developable photosensitive material of the present invention is preferably 0.2 to 30 g/m$^2$, and more preferably 1 to 15 g/m$^2$. The functional layer may be added with cross-linking agent for crosslinking or surfactant for improving coating property.

The image-forming layer of the heat-developable photosensitive material of the present invention contains organic binder. As the organic binder, a variety of synthetic polymers previously known (for, example, cellulose derivatives such as cellulose acetate, cellulose acetate butylate and sodium salt of carboxylmethylcellulose; and vinyl polymers such as polyvinylalcohol, polyvinyl acetate, polyvinyl butyral and polyvinyl formal); gelatin; agar; and polysaccharide are available.

In the present invention, at least one layer of the image-forming layer is preferably such that containing the polymer latex at 50 wt % or more of the total binder. The polymer latex can be selected from those listed for the functional layer. The polymer latex can be used not only for the image-forming layer, but also for the protective layer and back layer. Using the polymer latex for the protective layer and back layer is favorable when the heat-developable photosensitive material of the present invention is applied to printing where dimensional variation is in a critical issue.

In the present invention, the image-forming layer or the adjacent layer thereto preferably contains phthalic acid or derivatives thereof such as 4-methylphthalic acid, tetrachlorophthalic acid, tetrafluorophthalic acid, 3-methylphthalic acid, 3,5-dimethylphthalic acid, 4,5-dichlorophthalic acid, 3-phenylphthalic acid and 3-nitrophthalic acid.

The phthalic acid derivatives can be added, on the same side with the image-forming layer of the heat-developable photosensitive material, either to a photosensitive layer such as the image-forming layer or to a non-photosensitive layer such as the protective layer.

The amount of addition of the phthalic acid derivatives is preferably $10^{-4}$ to 1 mol per one mol of silver, and more preferably $10^{-3}$ to 0.3 mol, and still more preferably $10^{-3}$ to 0.1 mol. The phthalic acids can be used individually or in combination of two or more thereof.

The phthalic acid derivatives may be added in any form of solution, powder or solid microparticle dispersion. Dispersion of the solid microparticle is effected using a known pulverizing means (e.g. ball mill, vibrating ball mill, sand mill, colloid mill, jet mill androllermill). A dispersionaidmay beavailable fordispersing the solid microparticle.

The silver halide emulsion and/or organic silver salt for use in the present invention can successfully be prevented, by addition of antifoggant, stabilizer or stabilizer precursor, from additional fogging and from lowered sensitivity during the stock storage. Appropriate examples of antifoggants, stabilizers and stabilizer precursors, available individually or in combination, include thiazoniumsalts describedin U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechol described in U.S. Pat. No. 3,235,652; oximes, nitrons and nitroindazoles described in British Patent No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogen-substituted organic compounds described in U.S. Pat. Nos. 4,108,665 and 4,442,202; triazines described in U.S. Pat. No. 4,128,557, U.S. Pat. No. 4,137,079, U.S. Pat. No. 4,138,365 and U.S. Pat. No. 4,459,350; and phosphorus compounds described in U.S. Pat. No. 4,411,985.

The antifoggant which is preferably used in the present invention is organic halide, and the typical compounds are disclosed in JP-A-50-119624, JP-A-50-120328, JP-A-51-121332, JP-A-54-58022, JP-A-56-70543, JP-A-56-99335, JPA-59-90842, JP-A-61-129642, JP-A-62-129845, JP-A-6-208191, JP-A-7-5621, JP-A-7-2781, JP-A-8-15809 and U.S.

Pat. No. 5,340,712, U.S. Pat. No. 5,369,000 and U.S. Pat. No. 5,464,737.

The antifoggant used in the present invention may be added in any form of solution, powder or solid microparticle dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

While not being essential for implementing the present invention, it is advantageous in some cases to add a mercury (II) salt as an antifoggant to the emulsion layer. Preferred mercury(II) salts for this purpose are mercury acetate and mercury bromide. The amount of addition of mercury for use in the present invention is preferably from $10^{-9}$ to $10^{-3}$ mol per one mol of silver coated, and more preferably from $10^{-8}$ to $10^{-4}$ mol.

The heat-developable photosensitive material of the present invention may contain a benzoic acids for improving the sensitivity and for preventing fog. Any kind of benzoic acid derivatives are available for the present invention, where preferred examples of the structure include those described in U.S. Pat. Nos. 4,784,939 and 4,152,160 and JP-A-9-329863, JP-A-9-329864 and JP-A-9-281637. Although the benzoic acids for use in the present invention may be added to any portion of the photosensitive material, addition to a layer provided on the same side with the photosensitive layer is preferable, and to an organic-silver-salt-containing layer is more preferable. The benzoic acids may be added at any step during the preparation of the coating liquid. In the case of addition to the organic-silver-salt-containing layer, the benzoic acids may be added at any step within a period from the preparation of the organic silver salt to the preparation of the coating liquid, where addition in a period following the preparation of the organic silver salt and immediately before the coating is preferable. The benzoic acids may be added in any form of solution, powder or solid microparticle dispersion. It is also allowable to add the benzoic acids in a form of mixed solution containing other additives such as a sensitizing dye, reducing agent and color toner. The amount of addition of the benzoic acids can arbitrarily set, where a preferable range being from $10^{-6}$ to 2 mol, inclusive, per one mol of silver, and more preferably from $10^{-3}$ to 0.5 mol, inclusive.

The heat-developable photosensitive material of the present invention may contain mercapto compound, disulfide compound or thione compound so as to control the development by inhibiting or accelerating thereof, to improve the spectral sensitization efficiency, or to improve the storage stability before and after the development.

While any structure of mercapto compound may be available in the present invention, such that expressed by Ar—SM or Ar—S—S—Ar is preferable, wherein M represents a hydrogen atom or alkali metal atom; and Ar represents an aromatic ring or condensed aromatic ring containing one or more nitrogen, sulfur, oxygen, selenium or tellurium atoms. Preferable heteroaromatic rings include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g. Br, Cl), hydroxyl, amino, carboxyl, alkyl (e.g. alkyl having one or more carbon atoms, preferably from 1 to 4 carbon atoms), alkoxy (e.g. alkoxy having one or more carbon atoms, preferably from 1 to 4 carbon atoms) and aryl (which may also be substituted). Examples of the mercapto- substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate; N-methyl-N'-[3-(5-mercaptotetrazolyl)phenyl]urea, and 2-mercapto-4-phenyloxazole, while not particularly being limited thereto. The amount of the addition, into the emulsion layer, of the mercapto compounds is preferably from 0.0001 to 1.0 mol per one mol of silver, more preferably from 0.001 to 0.3 mol.

Next, the photosensitive silver halide used in the present invention will be detailed.

The photosensitive silver halide used in the present invention has no limitation with regard to its halogen composition, and any of silver chloride, silver chlorobromide, silver bromide, silver iodobromide and silver iodochlorobromide is available. The halogen composition distribution within the grain may be uniform, or the halogen composition may be changed stepwise or continuously. Silver halide grain with a core/shell structure may preferably be used, in which the structure is preferably of two- to five-fold, and more preferably of two- to four-fold. It is also preferable to adopt a technique for localizing silver bromide on the surface of silver chloride or silver cholorobromide.

Methods for producing photosensitive silver halide used in the present invention are well known in the art, and, for example, the methods described in *Research Disclosure*, No. 17029 (June, 1978) and U.S. Pat. No. 3,700,458 may be applied. The methods applicable to the present invention include such that adding a halogen-containing compound to the prepared organic silver salt to convert a part of silver contained therein into photosensitive silver halide, and such that adding a silver-supplying compound and a halogen-supplying compound to gelatin or other polymer solution to thereby prepare photosensitive silver halide grain which is then mixed with an organic silver salt, where the latter method is more preferable. The photosensitive silver halide grain preferably has a small grain size so as to prevent high white turbidity after image production. Specifically, the grain size is preferably 0.20 $\mu$m or less, more preferably from 0.01 to 0.15 $\mu$m, still more preferably from 0.02 to 0.12 $\mu$m. The term "grain size" as used herein means the length of an edge of the silver halide grain for the case that the grain is a normal crystal having cubic or octahedral shape; and means the diameter of a circle image having an area equal to the projected area of the major plane of the silver halide grain for the case that the grain is tabular; and means the diameter of a sphere having a volume equal to that of the silver halide grain for the case that the grain has other irregular shape such as sphere or rod.

Examples of the shape of the silver halide grain include cubic, octahedral, tabular, spherical, rod and pebble; among these, cubic and tabular shapes being preferred in the present invention. When a tabular silver halide grain is used, the average aspect ratio is preferably from 100:1 to 2:1, more preferably from 50:1 to 3:1. A silver halide grain having rounded corners is also preferably used. The plane indices (Miller indices) of the outer surface plane of a photosensitive silver halide grain is not particularly limited; however, it is preferred that [100] plane showing a high spectral sensitization efficiency upon adsorption of the spectral sensitizing dye occupies a large percentage. The percentage is preferably 50% or above, more preferably 65% or above, still more preferably 80% or above. The percentage of a plane with a Miller index of [100] can be determined by the method described in T. Tani, *J. Imaging Sci.*, 29, 165 (1985), which is based on the plane dependency of adsorption of the sensitizing dye between [111] and [100] planes.

The photosensitive silver halide grain for use in the present invention preferably contains a Group VII metal or Group VIII metal in the Periodic Table, or metal complex. The Group VII metal or Group VIII metal in the Periodic Table, or a center metal of the metal complex is preferably rhodium, rhenium, ruthenium, osmium or iridium. These metal complexes may be used individually, or in combination of two or more complexes of the same metal or different metals. The metal complex content is preferably from $1\times10^{-9}$ to $1\times10^{-2}$ mol per one mol of silver, and more preferably from $1\times10^{-8}$ to $1\times10^{-4}$ mol. With respect to the specific structure of the metal complexes, those having the structures described in JP-A-7-225449 may be used.

As the rhodium compound preferably used in the present invention relates to a water-soluble rhodium compound. Examples thereof include a rhodium(III) halide compounds; and rhodium complex salts having a halogen, amines or an oxalates as ligands, such as hexachlororhodium(III) complex salt, pentachloroaquorhodium(III) complex salt, tetrachlorodiaquorhodium(III) complex salt, hexabromorhodium(III) complex salt, hexaamminerhodium (III) complex salt and trioxalatorhodium(III) complex salt. These rhodium compounds are used in a dissolved form in water or other appropriate solvent, where a method commonly used for stabilizing the rhodium compound solution may be applied, in which an aqueous hydrogen halide solution (e.g. hydrochloric acid, bromic acid, fluoric acid) or alkali halide (e.g. KCl, NaCl, KBr, NaBr) is added. In place of using the water-soluble rhodium, separate silver halide grains predoped with rhodium may be added and dissolved at. the time of preparation of silver halide.

The amount of the rhodium compound added is preferably from $1\times10^{-8}$ to $5\times10^{-6}$ mol per one mol of silver halide, and more preferably from $5\times10^{-8}$ to $1\times10^{-6}$ mol.

The rhodium compound may appropriately be added at the time of production of silver halide emulsion grains or at respective stages before coating of the emulsion, where more preferable is to add the compound at the time of emulsion production to be incorporated into the silver halide grain.

Rhenium, ruthenium or osmium for use in the present invention is added in the form of water-soluble complex salt described in JP-A-63-2042, JP-A-1-285941, JP-A-2-20852 and JP-A-2-20855. An exceptionally preferred example thereof refers to a hexacoordinative complex salt represented by the following formula:

$$[ML_6]^{n-}$$

wherein M represents Ru, Re or Os; L represents a ligand; and n represents 0, 1, 2, 3 or 4. In this case, ammonium or alkali metal ion is used as counter ion, while the ion being of no importance.

Preferred examples of the ligand include halide ligand, cyanide ligand, cyanoxide ligand, nitrosyl ligand and thionitrosyl ligand. Specific examples of the complex for use in the present invention are shown below, while not being limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)]^{-}$ | $[RuCl_5(H_2O)]^{2-}$ |
| $[RUCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The amount of addition of these compounds is preferably from $1\times10^{-9}$ to $1\times10^{-5}$ mol per one mol of silver halide, and more preferably from $1\times10^{-8}$ to $1\times10^{-6}$ mol.

These compounds may be added appropriately at the time of preparation of silver halide emulsion grains or at respective stages before coating of the emulsion, where more preferable is to add the compound at the time of emulsion production to be incorporated into the silver halide grain.

As for adding the compound during the grain formation of silver halide and integrating it into a silver halide grain, applicable methods include such that previously adding an aqueous solution of metal complex powder together with or without NaCl or KCl to a solution of water-soluble salt or water-soluble halide during the grain formation; such that adding the compound as the third solution at the time of simultaneously mixing a silver salt and a halide solution to prepare silver halide grains by the triple jet method; and such that pouring a necessary amount of an aqueous metal complex solution into a reaction vessel during the grain formation. Among these, preferred is a method comprising adding an aqueous solution of metal complex powder together with or without NaCl or KCl to a water-soluble halide solution.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. These iridium compounds are used in a dissolved form in water or other appropriate solvent, where a method commonly used for stabilizing the iridium compound solution may be applied, in which an aqueous hydrogen halide solution (e.g. hydrochloric acid, bromic acid, fluoric acid) or alkali halide (e.g. KCl, NaCl, KBr, NaBr) is added. In place of using the water-soluble iridium, separate silver halide grains predoped with iridium may be added and dissolved at the time of preparation of silver halide.

The silver halide grain for use in the present invention may further contain a metal atom such as cobalt, iron, nickel, chromium, palladium, platinum, gold, thallium, copper and lead. As for cobalt, iron, chromium and ruthenium compound, hexacyano metal complex is preferably used. Specific examples thereof include ferricyanate ion, ferrocyanate ion, hexacyanocobaltate ion, hexacyanochromate ion and hexacyanoruthenate ion, while not being limited thereto. The phase of the silver halide, in which the metal complex is contained, is not particularly limited, and the phase may be uniform or the metal complex may be contained in a higher concentration in the core portion or in the shell portion.

The above-described metal is used preferably in an amount of from $1\times10^{-9}$ to $1\times10^{-4}$ mol per one mol of silver halide. The metal may be added at the time of preparation of the grains through converting it into a metal salt in the form of simple salt, double salt or complex salt.

The photosensitive silver halide grain may be desalted by water washing according to a method known in the art, such as noodle washing and flocculation, but the grain may not be desalted in the present invention.

The silver halide emulsion for use in the present invention is preferably subjected to chemical sensitization. The chemical sensitization may be performed using a known method such as sulfur sensitization, selenium sensitization, tellurium sensitization or noble metal sensitization. These sensitization method may be used alone or in any combination. When these sensitization methods are used in combination, preferable combinations include sulfur and gold sensitizations; sulfur, selenium and gold sensitizations; sulfur, tellurium and gold sensitizations; and sulfur, selenium, tellurium and gold sensitizations.

The sulfur sensitization applied to the present invention is usually performed by adding a sulfur sensitizer and stirring the emulsion at a temperature as high as 40° C. or above for a predetermined time. The sulfur sensitizer may be a known compound and examples thereof include, in addition to the sulfur compound contained in gelatin, various sulfur compounds such as thiosulfates, thioureas, thiazoles and rhodanines, where thiosulfate and thiourea are preferable. Although the amount of the sulfur sensitizer to be added varies depending upon various conditions such as pH, temperature and grain size of silver halide at the time of chemical ripening, it is preferably from $10^{-7}$ to $10^{-2}$ mol per one mol of silver halide, and more preferably from $10^{-5}$ to $10^{-3}$ mol.

The selenium sensitizer for use in the present invention may be a known selenium compound. The selenium sensitization is usually performed by adding a labile and/or non-labile selenium compound and stirring the emulsion at a temperature as high as 40° C. or above for a predetermined time. Examples of the labile selenium compound include those described in JP-B-44-15748, JP-B-43-13489, JP-A-4-25832, JP-A-4-109240 andJP-A-4-324855. Amongthese, particularly preferred are those expressed by formulae (VIII) and (IX) of JP-A-4-324855.

The tellurium sensitizer for use in the present invention is a compound capable of producing silver telluride, presumably serve as a sensitization nucleus, on the surface or inside of silver halide grain. The rate of the formation of silver telluride in a silver halide emulsion can be examined according to a method described in JP-A-5-313284. Examples of the tellurium sensitizer include diacyl tellurides, bis(oxycarbonyl) tellurides, bis(carbamoyl) tellurides, bis(oxycarbonyl) ditellurides, bis(carbamoyl) ditellurides, compounds having a P═Te bond, tellurocarboxylates, Te-organyltellurocarboxylic esters, di(poly)tellurides, tellurides, tellurols, telluroacetals, tellurosulfonates, compounds having a P—Te bond, Te-containing heterocycles, tellurocarbonyl compounds, inorganic tellurium compounds and colloidal tellurium. Specific examples thereof include the compounds described in U.S. Pat. No. 1,623,499, U.S. Pat. No. 3,320,069 and U.S. Pat. No. 3,772,031; British Patents No. 235,211, U.S. Pat. No. 1,121,496, U.S. Pat. No. 1,295,462 and U.S. Pat. No. 1,396,696; Canadian Patent No. 800,958; JP-A-4-204640, JP-A-4-271341, JP-A-4-333043, JP-A-5-303157; *J. Chem. Soc. Chem. Commun.*, 635 (1980), ibid., 1102 (1979); ibid., 645 (1979); *J. Chem. Soc. Perkin. Trans.*, 1, 2191 (1980); S. Patai (compiler), *The Chemistry of Organic Selenium and Tellurium Compounds*, Vol. 1 (1986); and ibid., Vol. 2 (1987). The compounds expressed by formulae (II), (III) and (IV) of JPA-9-313284 are particularly preferred.

The amount of the selenium or tellurium sensitizer used in the present invention varies depending on silver halide grains used or chemical ripening conditions. However, it is generally from $10^{-8}$ to $10^{-2}$ mol per one mol of silver halide, preferably on the order of from $10^{-7}$ to $10^{-3}$ mol. The conditions for chemical sensitization in the present invention are not particularly restricted. However, in general, pH is from 5 to 8; pAg is from 6 to 11, preferably from 7 to 10; and temperature is from 40 to 95° C., preferably from 45 to 85° C.

Noble metal sensitizers for use in the present invention include gold, platinum, palladium and iridium, and particularly, gold sensitization is preferred. Examples of the gold sensitizers used in the present invention include chloroauric acid, potassium chloroaurate, potassium aurithiocyanate and gold sulfide, which can be used in an amount of approx. $10^{-7}$ to $10^{-2}$ mol per one mol of silver halide.

As for the silver halide emulsion for use in the present invention, production or physical ripening process for the silver halide grain may be performed under the presence of cadmium salt, sulfite, lead salt or thallium salt.

In the present invention, reductive sensitization may be adoptable. Specific examples of the compound used in the reductive sensitization include ascorbic acid, thiourea dioxide, stannous chloride, aminoiminomethanesulfinic acid, hydrazine derivative, borane compound, silane compound and polyamine compound. The reductive sensitization may be performed by ripening the grains while keeping the emulsion at pH 7 or above, or at pAg 8.3 or less. Also, the reductive sensitization may be performed by introducing a single addition portion of silver ion during the formation of the grains.

To the silver halide emulsion for use in the present invention, thiosulfonic acid compound may be added by the method described in European Patent No. 293917A.

In the heat-developable photosensitive material used for the present invention, a single kind of silver halide emulsion may be used, or two or more kinds of silver halide emulsions (for example, those differ in the average grain size, halogen composition, crystal habit or chemical sensitization conditions) may be used in combination.

The amount of the photosensitive silver halide used in the present invention is preferably from 0.01 to 0.5 mol per one mol of the organic silver salt, more preferably from 0.02 to 0.3 mol, still more preferably from 0.03 to 0.25 mol. Methods for mixing photosensitive silver halide and organic silver salt separately prepared include such that mixing, after completion of the individual preparation, the silver halide grains and the organic silver salt in a high-speed stirrer, ball mill, sand mill, colloid mill, vibrating mill, homogenizer or the like; and such that mixing, at any timing during preparation of the organic silver salt, already-finished photosensitive silver halide to prepare the organic silver salt; while not being limited thereto as far as sufficient effects of the present invention are obtained.

The organic silver salt used in the present invention is a silver salt which is relatively stable against light exposure but can produce silver image when heated at 80° C. or higher in the presence of light-exposed photocatalyst (e.g. latent image of photosensitive silver halide) and reducing agent. The organic silver salt may be any organic substance containing a source capable of reducing the silver ion. Silver salt of organic acid, in particular, silver salt of long-chained aliphatic carboxylic acid (with a carbon number of 10 to 30, and preferably 15 to 28) is preferred. Complex of organic or inorganic silver salt, whose ligand has a complex stability constant of from 4.0 to 10.0, is also preferred. The silver-supplying substance may preferably constitute approx. 5 to 70 wt % of the image-forming layer. Preferable organic silver salt includes silver salt of organic compound having carboxyl group. Examples thereof include silver salts of aliphatic carboxylic acid and aromatic carboxylic acid, while not being limited thereto. Preferred examples of the silver salt of the aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and mixtures thereof.

Silver salts of compounds having mercapto or thione group and derivatives thereof may also be used as the organic silver salt. Preferred examples of these compounds include silver salt of 3-mercapto-4-phenyl-1,2,4-triazole; silver salt of 2-mercaptobenzimidazole; silver salt of 2-mercapto-5-aminothiadiazole; silver salt of 2-(ethylglycolamido)benzothiazole; silver salts of thioglycolic acids such as silver salt of 2-alkylthioglycolic acids (whose alkyl group having a carbon number of 12 to 22); silver salts of dithiocarboxylic acids such as silver salt of dithioacetic acid; silver salt of thioamides; silver salt of 5-carboxyl-1-methyl-2-phenyl-4-thiopyridine; silver salt of mercaptotriazines; silver salt of 2-mercaptobenzoxazole; silver salts of 1,2,4-mercaptothiazole derivatives such as silver salt of 3-amino-5-benzylthio-1,2,4-thiazole as described in U.S. Pat. No. 4,123,274; and silver salts of thione compounds such as silver salt of 3-(3-carboxyethyl)-4-methyl-4-thiazoline-2-thione as described in U.S. Pat. No. 3,301,678. Compounds containing imino group may also be used. Preferred examples of these compounds include silver salt of benzotriazole and derivatives thereof, for example, silver salt of benzotriazoles such as silver methylbenzotriazole; silver salts of halogenated benzotriazoles such as silver 5-chlorobenzotriazole; silver salts of 1,2,4-triazole and 1H-tetrazole, and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The shape of the organic silver salt which can be used in the present invention is not particularly limited but an acicular crystal form having a short and long axes is preferred. In the present invention, the short axis is preferably from 0.01 to 0.20 $\mu$m, more preferably from 0.01 to 0.15 $\mu$m, and the long axis is preferably from 0.10 to 5.0 $\mu$m, more preferably from 0.10 to 4.0 $\mu$m. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. The shape of the organic silver salt can be determined based on the image of organic silver salt dispersion observed with a transmission type electron microscope. Another method for determining the monodispersibility is such that obtaining the standard deviation of volume load average diameter of the organic silver salt. The percentage (coefficient of variation) of the value obtained by dividing the standard deviation by the volume load average diameter is preferably 100% or less, more preferably 80% or less, still more preferably 50% or less. The measurement procedures include irradiating laser light to the organic silver salt dispersed in a solution; deriving an autocorrelation function with respect to the time-dependent fluctuation in the scattered light; and thereby obtaining grain size (volume load average diameter).

The organic silver salt used in the present invention is preferably desalted. The desalting method is not particularly limited and a known method may be used. Known filtration methods such as centrifugal filtration, suction filtration, ultrafiltration and flocculation washing based on coagulation may be preferably used.

To obtain a solid dispersion of the organic silver salt with high S/N ratio, small grain size and no coagulation, it is preferable in the present invention to employ a dispersion method in which water dispersion, containing the organic silver salt as an image-forming medium and containing substantially no photosensitive silver salt, is converted into a high-speed flow, which is then subjected to pressure drop.

After such process, the water dispersion is mixed with aqueous photosensitive silver salt solution to produce a coating liquid of photosensitive image-forming medium. Using such coating liquid ensures a heat-developable photosensitive material with low haze, low fog and high sensitivity. On the other hand, presence of the photosensitive silver salt at the time of dispersion through the conversion into high-pressure, high-speed flow will result in increased fog and significantly lowered sensitivity. Using organic solvent, in place of water, also tends to raise the haze, increase the fog and lower the sensitivity. Employing the conversion method, in which a part of the organic silver salt in the dispersion is converted into photosensitive silver salt, may lower the sensitivity.

The water dispersion dispersed after converted into the high-pressure, high-speed flow contains substantially no photosensitive silver salt, has a water content of 0.1 mol % or less with respect to the non-photosensitive organic silver salt, and is not subjected to intentional addition of photosensitive silver salt.

Solid dispersion apparatuses and technologies for implementing the above dispersion method are detailed, for example, in "Bunsanka Rheology to Bunsanka Gijutu (Dispersed Rheology and Dispersion Technology)", by Toshio Kajiuchi and Hiroki Usui, 1991, issued by Sinzansha Shuppann, p.357–403; and "Kagaku Kogaku no Sinpo (Advances in Chemical Engineering) Vol.24", ed. Tokai Section, The Society of Chemical Engineers, 1990, issued by Maki Shoten, p.184–185. According to the dispersion method employed in the present invention, the water dispersion containing at least organic silver salt is fed to a piping while being pressurized with a high-pressure pump, then allowed to pass through a narrow slit, which causes an abrupt pressure drop to the water dispersion and thereby enables fine dispersion.

As for a high-pressure homogenizer available in the present invention, dispersion into fine particles is generally considered to be effected by dispersion force such as (a) "shearing force" generated when dispersoid passes through a narrow gap under high pressure and at high speed, and (b) "cavitation force" generated when the high pressure exerted on the dispersoid is released to the normal pressure. galling homogenizer has long been known as such kind of dispersion apparatus, in which pressure-fed process solution to be dispersed is converted into a high-speed flow at a narrow gap on a cylinder surface, then rushed to be collided with the peripheral wall, thereby allowing emulsification or dispersion assisted by the impact force. Operating pressure is, in general, selected in a range from 100 to 600 kg/cm$^2$, and flow rate in several to 30 m/second. There is also proposed an apparatus such that having a sawtoothed high flow rate portion to increase the number of collision for a higher dispersion efficiency. In recent years, there has also been developed apparatuses allowing dispersion at higher pressure and faster flow rate, which are typified as Microfluidizer (Microfluidex International Corporation) and Nanomizer (Tokushu Kika Kogyo Co., Ltd.).

Dispersion apparatuses appropriate to the present invention include Microfluidizer M-110S-EH (with G10Z interaction chamber), M-110Y (with H10Z interaction chamber), M-140K (with G10Z interaction chamber), HC-5000 (with L30Z or H230Z interaction chamber) and HC-8000 (with E230Z or L30Z interaction chamber), all of which manufactured by Microfluidex International Corporation.

Using these apparatuses, water dispersion containing at least organic silver salt is fed to a piping while being pressurized with a high-pressure pump or so, then the dispersion is passed through a narrow slit provided in the piping thereby to apply desired pressure, and then the pressure within the piping is quickly released to recover the atmospheric pressure thereby to cause abrupt pressure drop of the dispersion. Thus can be obtained the organic silver salt dispersion optimum for the present invention.

In the present invention, it is possible to disperse the organic silver salt so as to attain a desired grain size by properly adjusting the flow rate, pressure difference at the time of the pressure drop and the number of repetition of the process. Taking photographic properties and the grain size into account, the flow rate is preferably from 200 to 600 m/sec, more preferably from 300 to 600 m/sec, and the pressure difference at the pressure drop is preferably from 900 to 3000 kg/cm$^2$, and more preferably from 1500 to 3000 kg/cm$^2$. The number of repetition of the process is selectable as required. While this is generally selected as once to as much as 10 times, once to as much as 3 times is preferred from the viewpoint of productivity. Raising the temperature of such water dispersion under high pressure is undesirable from the viewpoint of dispersibility and photographic properties, that is, raising the temperature above 90° C. tends to result in increased grain size and increased fogging. It is thus preferable in the present invention to provide a cooling step before the conversion into the high-pressure, high-speed flow and/or after the pressure drop, to maintain the temperature of the water dispersion within a range from 5 to 90° C., more preferably from 5 to 80° C., and still more preferably to 65° C. Providing such cooling step is exceptionally effective when the dispersion is proceeded under the pressure as high as 1500 to 3000 kg/cm$^2$. A cooler is properly selected, depending on the required capacity of heat exchange, from those being equipped with a double pipe or double pipe as combined with a static mixer; shell-and-tube heat exchanger; and coiled heat exchanger. The diameter, wall thickness and material of the pipe are properly be selected, considering the operating pressure, so as to improve the efficiency of the heat exchange. Coolants available for the cooler include well water at 20° C.; cold water at 5 to 10° C. fed from a chiller; and, as requested, ethyleneglycol/water at −30° C.

In the dispersion process of the present invention, the organic silver salt is preferably dispersed under the presence of a dispersant (dispersion aid) soluble to water-base solvents. The dispersant can be suitably selected from, for example, synthetic anionic polymers such as polyacrylic acid, copolymers of acrylic acid, maleic acid copolymers, maleic acid monoester copolymers and acryloylmethylpropanesulfonic acid copolymers; semisynthetic anionic polymers such as carboxymethylated starch and carboxymethylcellulose; anionic polymers such as alginic acid and pectic acid; compounds disclosed in JP-A-7-350753; known anionic, nonionic and cationic surfactants; other known polymers such as polyvinyl alcohol, polyvinylpyrrolidone, carboxymethyl cellulose, hydroxypropyl cellulose, and hydroxypropylmethyl cellulose; naturally occurring polymers such as gelatin and the like. Most preferable are polyvinyl alcohols and water-soluble cellulose derivatives.

The dispersant is generally mixed with the organic silver salt in a form of powder or wet cake before the dispersing operation, and fed as slurry into a dispersion apparatus, whereas the dispersant may also be included in the powder or wet cake by heat treatment or solvent treatment of the dispersant premixed with the organic silver salt. The pH may be controlled with a suitable pH adjusting agent during or after the dispersing operation.

Besides such mechanical dispersing operation, the organic silver salt can preliminarily be dispersed into solvent by pH control, and then can thoroughly be dispersed by altering pH under the presence of the dispersant. The solvent for the preliminary dispersion may be organic solvent, which is generally removed after the thorough dispersion.

The produced dispersion can be stored under stirring in order to prevent precipitation of the microparticles during storage, or stored in a highly viscous state by producing hydrophilic colloid (e.g. jelly state formed with gelatin). Further, it may be added with a preservative in order to prevent germ proliferation during the storage.

In the present invention, the silver salt can be used in adesired amount, which is preferably 0.1 to 5 g/m$^2$ as an amount of silver, and more preferably 1 to 3 g/m$^2$.

The image-forming layer in the heat-developable photosensitive material of the present invention may contain a plasticizer or lubricant, and examples thereof include polyhydric alcohols (for example, glycerin and diol described in U.S. Pat. No. 2,960,404); fatty acid or ester described in U.S. Pat. Nos. 2,588,765 and 3,121,060; and silicone resin described in British Patent No. 955,061.

The heat-developable photosensitive material of the present invention may have a surface protective layer for preventing adhesion of the image-forming layer.

Any kind of polymer is available for a binder contained in the surface protective layer in the heat-developable photosensitive material of the present invention, where it is preferable that a polymer having carboxylic acid residues is used at an amount from 100 mg/m$^2$ to 5 g/m$^2$. The polymers having carboxylic acid residues described herein include natural polymers (e.g. gelatin, arginic acid); modified natural polymers (e.g. carboxymethylcellulose, phthalized gelatin); and synthetic polymers (e.g. polymethacrylate, polyacrylate, polyalkylmethacrylate/acrylate copolymer, polystyrene/polymethacrylate copolymer). Contents of the carboxylic acid residues in these polymers are preferably 10 nmol to 1.4 mol per 100 g of polymer. The carboxylic acid residues can form salts with, for example, alkali metal ion, alkali earth metal ion and organic cation.

Any kind of adhesion preventive material is available for the surface protective layer in the present invention. Examples of the adhesion preventive material include wax; silica particle; styrene-containing elastomeric block copolymer (e.g. styrene-butadiene-styrene, styrene-isoprene-styrene); cellulose acetate; cellulose acetate butylate; cellulose propionate; and mixtures thereof. The surface protective layer may also contain a crosslinking agent for crosslinking, and surfactant for improving coating property.

The image-forming layer and the protective layer thereof in the present invention may contain a photographic element comprising a light absorbing substance and filter dye as described in U.S. Pat. No. 3,253,921, U.S. Pat. No. 2,274,782, U.S. Pat. No. 2,527,583 and U.S. Pat. No. 2,956,879. It is also allowable to dye through mordanting as described, for example, in U.S. Pat. No. 3,282,699. The filter dye is preferably used in an amount so as to attain an absorbance of 0.1 to 3, and more preferably 0.2 to 1.5.

The photosensitive image-forming layer in the heat-developable photosensitive material of the present invention may contain a dye or pigment of various types so as to improve the color tone or prevent the irradiation. Any dye or pigment may be used in the photosensitive image-forming layer, and examples thereof include pigments and dyes listed in the Color Index. Specific examples thereof include organic pigments and inorganic pigments such as pyrazoloazole dye, anthraquinone dye, azo dye, azomethine dye, oxonol dye, carbocyanine dye, styryl dye, triphenylmethane dye, indoaniline dye, indophenol dye and phthalocyanine. Preferred examples of the dye for use in the present invention include anthraquinone dyes (e.g. Compounds 1 to 9 described in JPA-9-341441, Compounds 3-6 to 3-18 and 3-23 to 3-38 described in JPA-9-165147), azomethine dyes (e.g. Compounds 17 to 47 described in JPA-9-341441), indoaniline dyes (e.g. Compounds 11 to 19 described in JPA-9-289227, Compound 47 described in JP-A-5–341441, Compounds 2-10 and 2-11 described in JPA-9-165147/1993) and azo dyes (Compounds 10 to 16 described in JPA-9-341441). The dye may be added in any form of solution, emulsified product or solid microparticle dispersion or may be added in the state mordanted with a polymer mordant. The amount of such compounds used may be determined according to desired absorbance, and, in general, the compounds are preferably used in an amount of from $1\times10^{-6}$ to 1 g per 1 $m^2$ of the heat-developable photosensitive material.

The heat-developable photosensitive material of the present invention is preferably of a so-called single-sided type comprising a support having on one side thereof at least one image-forming layer such as a photosensitive layer containing a silver halide emulsion and on the other side thereof a back layer.

In the present invention, the back layer preferably has a maximum absorption in a desired wavelength region of from approx. 0.3 to 2.0. For the desired wavelength region of 750 to 1400 nm, the back layer is preferably an antihalation layer with an optical density within a wavelength region from 360 to 750 nm of 0.005 or larger and less than 0.5, and more preferably 0.001 or larger and less than 0.3. For the desired wavelength region of 750 nm or shorter, the back layer is preferably an antihalation layer with a maximum optical density within such desired wavelength region before image formation of 0.3 to 2.0, and with an optical density within a wavelength region from 360 to 750 nm after the image formation of 0.005 or larger and less than 0.3. There is no limitation on the method for lowering the optical density into the above-described range after the image formation, where possible methods include such that using heat-assisted fading of dye color described in Belgian Patent No. 733,706, and that decreasing the density by photoirradiation-assisted fading described in JP-A-54-17833.

In the case when an antihalation dye is used in the present invention, the dye,may be any compound so long as the compound has a desired absorption in the desired wavelength region, the absorption in the visible wavelength region can sufficiently be reduced after the processing, and the back layer can have a preferred absorption spectrum form. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and 24539/1991 (from page 14, left lower column to page 16, right lower column); and as a dye which is faded after the processing, the compounds described in JP-A-52-139136, JP-A-53-132334, JP-A-56-501480, JP-A-57-16060, JP-A-57-68831, JP-A-57-101835, JPA-59-182436, JP-A-7-36145, JP-A-7-199409, JP-B-48-33692, JP-B-50-16648, JP-B-2-41734 and U.S. Pat. No. 4,088,497, U.S. Pat. No. 4,283,487, U.S. Pat. No. 4,548,896 and U.S. Pat. No. 5,187,049.

The binder preferably applied to the back layer in the present invention is transparent or semi-transparent, colorless in general, and can be made of natural polymer synthetic resin, polymer and copolymer, as well as other film-forming media such as gelatin, gum arabic, poly(vinyl alcohol), hydroxyethylcellulose, cellulose acetate, cellulose acetate butylate, poly(vinylpyrrolidone), casein, starch, poly(acrylic acid), poly(methyl methacrylate), poly(vinyl chloride), poly (methacrylic acid), copoly(styrene-maleic anhydride), copoly(styrene-acrylonitrile), copoly(styrene-butadiene), polyvinyl acetals (such as poly(vinylformal) and poly (vinylbutyral)), polyesters, polyurethanes, phenoxy resin, poly(vinylidene chloride), polyepoxides, polycarbonates, poly(vinyl acetate), cellulose esters and polyamides. The binder may also be formed by coating from water, organic solvent or emulsion.

In the heat-developable photosensitive material of the present invention, a matting agent may be added into the surface protective layer of the photosensitive emulsion layer and/or back layer, or into the surface protective layer for the back layer. The matting agent appears, in general, as organic or inorganic fine particles insoluble to water. Arbitrary matting agents are available, examples of which include organic matting agents disclosed in U.S. Pat. No. 1,939,213, U.S. Pat. No. 2,701,245, U.S. Pat. No. 2,322,037, U.S. Pat. No. 3,262,782, U.S. Pat. No. 3,539,344 and U.S. Pat. No. 3,767,448; and inorganic matting agents disclosed in U.S. Pat. No. 1,260,772, U.S. Pat. No. 2,192,241, U.S. Pat. No. 3,527,206, U.S. Pat. No. 3,370,951, U.S. Pat. No. 3,523,022 and U.S. Pat. No. 3,769,020; all of which being well known in the related art. More specifically, the organic compounds available as the matting agent include water-dispersible vinyl polymers such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate and polytetrafluoroethylene; cellulose derivatives such as methylcellulose, cellulose acetate, and cellulose acetate propionate; starch derivatives such as carboxystarch, carboxynitrophenylstarch, and urea-formaldehyde-starch reaction product; gelatin hardened with a known hardening agent; and hardened gelatin in a form of fine capsulated hollow particle obtained by coacervate hardening. Preferable examples of the inorganic compounds include silicon dioxide, titanium dioxide, magnesium dioxide, aluminium oxide, barium sulfate, calcium carbonate, silver chloride desensitized by a known method, silver bromide similarly processed, glass and diatom earth. Different kinds of the matting agent may be combined for use as required. There are no special limitation on the size and morphology of the matting agent, and that having an arbitrary diameter is available. For implementing the present invention, it is preferable to use a matting agent with 0.1 to 30 μm diameter.

Both of wide and narrow particle size distributions of the matting agent are allowable. Since the matting agent largely affects the haze and surface gloss of the photosensitive material, the particle size, morphology and particle size distribution of which are preferably selected as required at the time of preparation of the matting agent, or sometimes by mixing two or more matting agents.

A preferable embodiment of the present invention relates to adding the matting agent to the back layer, where the degree of matting of the back layer is preferably expressed as a Bekk smoothness of 10 to 250 seconds, and more preferably 50 to 180 seconds.

In the present invention, the matting agent is preferably added to an outermost layer or a layer functions as the outermost layer of the photosensitive material, or to a layer provided near the outer surface thereof, and in particular to a layer functions as a so-called protective layer. While there is no special limitation on the degree of matting so long as stardust failure does not occur, the Bekk smoothness falls preferably within a range from 500 to 10,000 seconds, and more preferably 500 to 2,000 seconds.

The photosensitive image-forming layer in the heat-developable photosensitive material of the present invention is composed on the support in one or more layers. In the monolayer composition, the layer must contain organic silver salt, photosensitive silver halide, reducing agent and binder, and may additionally contain color toner, coating aid and other auxiliary agents. In the double-layer composition, the first emulsion layer (usually adjacent to the substrate) must contain an organic silver salt and a silver halide, and the second layer or both layer must contain some other components. Alternative double-layer composition may be allowable in which a single emulsion layer contains all components and a protective topcoat is provided thereon. A multicolor photosensitive heat-developable photographic material may have a structure such that a combination of the above-described two layers is provided for the respective colors, or, as described in U.S. Pat. No. 4,708,928, a structure such that a single layer contains all components. In the case of a multi-dye multi-color photosensitive heat-developable photographic material, the respective emulsion layers are generally kept away from each other by using a functional or non-functional barrier layer between the respective light-sensitive layers as described in U.S. Pat. No. 4,460,681.

A backside resistive heating layer described in U.S. Pat. Nos. 4,460,681 and 4,374,921 may also be used in the heat-developable photosensitive photographic imaging system of the present invention.

In the present invention, layers such as the image-forming layer, protective layer and back layer each may contain a hardening agent. Examples of the hardening agent include polyisocyanates described in U.S. Pat. No. 4,281,060 and JP-A-6-208193; epoxycompounds described, for example, in U.S. Pat. No. 4,791,042; and vinyl sulfone-based compounds described, for example, in JP-A-62–89048.

Surfactants may preferably used in the present invention to improve the coating property and electric charging. Nonionic, anionic, cationic, fluorine-containing, and any other types of surfactants are properly available. More specifically, they are exemplified as fluorine-containing polymer surfactants disclosed, for example, in JP-A-62-170950 and U.S. Pat. No. 5,380,644; fluorine-containing surfactants disclosed, for example, in JP-A-60-244945 and JP-A-63-188135; polysiloxane-based surfactants disclosed, for example, in U.S. Pat. No. 3,885,965; polyalkyleneoxcide disclosed, for example, in JP-A-6-301140; and anionic surfactants.

The heat-developable photosensitive emulsion in the present invention may be coated on a variety of supports. Typical supports include polyester film, undercoat polyester film, poly(ethylene terephthalate) film, poly(ethylene naphthalate) film, cellulose nitrate film, cellulose ester film, poly(vinyl acetal) film, polycarbonate film and related resin material, glass, paper and metal. Typically used are flexible materials, in particular, partially acetylated paper support; and paper support coated with baryta and/or α-olefin polymer; the α-olefin polymer being, in particular, a polymer of α-olefin with a carbon number of 2 to 10, such as polyethylene, polypropylene and ethylene-butene copolymer. Both of transparent and opaque supports are allowable, the former being more preferable. Among these, exceptionally preferable is polyethylene terephthalate film of 75 to 200 μm thick processed by biaxial stretching.

In general, plastic film will alter its dimension when passed through a heat developing apparatus for processes at 80° C. or above. Such dimensional change will raise a critical problem in precision multicolor printing when the processed film is used for printing plate making. It is therefore preferable in the present invention to use a film with less dimensional change devised so that the residual internal distortion in the film is relieved during the biaxial stretching to prevent distortion by heat shrinking during the heat development. Preferably used is a polyethylene terephthalate film subjected to heat treatment at 100 to 210° C. before the heat-developable photosensitive emulsion is coated thereon. Materials with high glass transition temperatures are also preferably used, and such materials include polyether ethyl ketone, polystyrene, polysulfone, polyethersulfone, polyarylate and polycarbonate.

The heat-developable photosensitive material of the present invention may have, for an antistatic purpose, a layer containing or comprising soluble salts (e.g. chloride, nitrate); vapor-deposited metal; ionic polymers disclosed in U.S. Pat. Nos. 2,861,056 and 3,206,312; insoluble inorganic salts disclosed in U.S. Pat. No. 3,428,451; and stannic oxide particles disclosed in JP-A-60-252349 and JP-A-57-104931.

A method for obtaining a color image using the heat-developable photosensitive material of the present invention is described in JP-A-7-13295, from line 43 on page 10 in the left column to line 40 on page 11 in the left column. Stabilizing agents for color dye image are described in British Patent No. 1,326,889, U.S. Pat. No. 3,432,300, U.S. Pat. No. 3,698,909, U.S. Pat. No. 3,574,627, U.S. Pat. No. 3,573,050, U.S. Pat. No. 3,764,337 and U.S. Pat. No. 4,042,394.

The heat-developable photosensitive emulsion in the present invention may be coated by a variety of coating processes, which include dip coating, air knife coating, flow coating, and extrusion coating using a specific hopper described in U.S. Pat. No. 2,681,294. It is also allowable to coat two or more layers as required according to the methods described in U.S. Pat. No. 2,761,791 and British Patent No. 837,095.

The heat-developable photosensitive material of the present invention may have additional layers such as dye accepting layer for accepting mobile dye image, opaque layer for effectuating reflective printing, protective top coat layer, and primer layer already known in the field of photothermal printing technology. It is preferable that the heat-developable photosensitive material of the present invention is capable of producing image solely by itself. That is, it is preferable that the functional layer necessary for forming image, such as image accepting layer, is not provided on the separate photosensitive material.

The sensitizing dye used in the present invention may arbitrarily be selected from those capable of spectrally sensitizing the silver halide particles at a desired wavelength region by adhering thereon. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), ibid. Item 1831X (August, 1978, page 437) and also in the references as cited therein. In particular, sensitizing dyes having a spectral sensitivity suitable for spectral characteristics of light sources of various laser imagers, scanners, image setters, process cameras and the like can advantageously be selected.

Exemplary dyes advantageous for the spectral sensitization to red light from so-called red light sources such as He-Ne laser, red semiconductor laser and red LED, include Compounds I-1 to I-38 disclosed in JP-A-54-18726; Compounds I-1 to I-35 disclosed in JP-A-6-75322; Compounds I-1 to I-34 disclosed in JP-A-7-287338; Dyes 1 to 20 disclosed in JP-B-55-39818; Compounds I-1 to I-37 disclosed in JP-A-62-284343; and Compounds I-1 to I-34 disclosed in JP-A-7-287338.

Spectral sensitization as to the wavelength region of from 750 to 1,400 nm from semiconductor laser light sources can advantageously be obtained with various known dyes such as cyanine dye, merocyanine dye, styryl dye, hemicyanine dye, oxonol dye, hemioxonol dye and xanthene dye. Useful cyanine dyes are those having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are those having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described, for example, in U.S. Pat. No. 3,761,279, U.S. Pat. No. 3,719,495 and U.S. Pat. No. 3,877,943, British Patents No. 1,466,201, U.S. Pat. No. 1,469,117 and U.S. Pat. No. 1,422,057, JP-B-3–10391 and JP-B-6-52387, JPA-9-341432, JP-A-6-194781 and JP-6-A-301141.

The dyes particularly preferably used for the present invention include cyanine dyes having a thioether bond (e.g. those described in JP-A-62-58239, JP-A-3-138638, JP-A-3-138642, JP-A-4-255840, JPA-9-72659/1993, JPA-9-72661, JP-A-6-222491, JP-A-2-230506, JP-A-6-258757, JP-A-6-317868, JP-A-6-324425, JP-W-A-7-500926 (the code "JP-W-A" as used herein means an "international application published in Japanese for Japanese national phase"), and U.S. Pat. No. 5,541,054); dyes having a carboxylic acid group (e.g. dyes disclosed in JP-A-3-163440, JP-A-6-301141, and U.S. Pat. No. 5,441,899); merocyanine dyes; polynuclear merocyanine dyes; and polynuclear cyanine dyes (those disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-W-A-55-50111, British Patent No. 1,467,638, and U.S. Pat. No. 5,281,515) and the like.

Dyes forming J-band have been disclosed in U.S. Pat. Nos. 5,510,236 and 3,871,887 (Example 5), JP-A-2-96131 and JPA-59-48753, and the like, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect, or a material which absorbs substantially no visible light but exhibits supersensitization may be incorporated into the emulsion. Useful sensitizing dyes, combinations of dyes which exhibit supersensitization, and materials which show supersensitization are described in Research Disclosure, Vol. 176, 17643, page 23, Item IV-J (December, 1978), JP-B-49-25500 and JP-B-43-4933, JPA-59-19032 and JPA-59-192242, and the like.

The sensitizing dye may be added to the silver halide emulsion by dispersing it directly in the emulsion or may be added to the emulsion after dissolving it in a solvent such as water, methanol, ethanol, propanol, acetone, Methyl Cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide; these solvents being used solely or by mixing.

Furthermore, the sensitizing dye may be added using a method disclosed in U.S. Pat. No. 3,469,987 by which the dye is dissolved in a volatile organic solvent, the obtained solution is then dispersed in water or hydrophilic colloid, and the obtained dispersion is added to the emulsion; methods disclosed in JP-B-44-23389, JP-B-44-27555 and JP-B-57-22091 by which the dye is dissolved in an acid, and then the obtained solution is added to the emulsion as it were or in the form of aqueous solution under the presence of acid or base; methods disclosed in U.S. Pat. Nos. 3,822,135 and 4,006,025 by which the dye, under the presence of surfactant, in a form of aqueous solution or colloid dispersion is added to the emulsion; methods disclosed in JP-A-53-102733 and JP-A-58-105141 by which the dye is dispersed directly in hydrophilic colloid and the obtained dispersion is added to the emulsion; or a method disclosed in JP-A-51-74624 by which the dye is dissolved using a compound capable of red shifting and the obtained solution is added to the emulsion. An ultrasonic wave may also be used in dissolving the dye.

In the preparation of the emulsion, the sensitizing dye may be added in any process steps as far as efficiency of which ever authorized. For example, in the grain formation process of silver halide and/or before desalting, or during the desalting process and/or the time period from desalting up to the initiation of chemical ripening, as disclosed in U.S. Pat. No. 2,735,766, U.S. Pat. No. 3,628,960, U.S. Pat. No. 4,183,756 and U.S. Pat. No. 4,225,666, JP-A-58-184142 and JP-A-60-196749, or immediately before or during the chemical ripening process, or in the time period after chemical ripening up to coating, as disclosed in JP-A-58-113920. Furthermore, as disclosed in U.S. Pat. No. 4,225,666 and JP-A-58-7629/1983, a single kind of compound per se may be added in parts or the compound in combination with another compound having a different structure may be added in parts, for example, one part is added during grain formation and another part is added during or after the chemical ripening; or one part is added before or during the chemical ripening and another part is added after completion of the chemical ripening. When the compound is added in parts, the compound or combination of the compound added in parts may be altered for each addition process.

The amount of the sensitizing dye used in the present invention may be selected according to the performance such as sensitivity or fog; where it is preferably from $10^{-6}$ to 1 mol per one mol of silver halide in the photosensitive layer, and more preferably from $10^{-4}$ to $10^{-1}$ mol.

In the present invention, a contrast accelerator may be used in combination with the above-described ultrahigh contrast agent so as to produce an ultrahigh contrast image. Examples thereof include amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14.

The heat-developable photosensitive material of the present invention may be developed by any method, while in general the development is performed by elevating the temperature of the heat-developable photosensitive material after the imagewise exposure. Preferred embodiments of the heat-developing apparatus used include: those making the heat-developable photosensitive material into contact with a heat source such as a heat roller or heat drum as disclosed in JP-B-5-56499, Japanese Patent No.684453, JP-A-9-292695, JP-A-9-297385 and International Patent Publication WO95/30934; and those of non-contacting type as disclosed in JP-A-7-13294, International Patent Publications WO97/28489, WO97/28488 and WO97/28487. Of these, the non-contacting type heat-developing apparatus is preferred. The development temperature is preferably from 80 to 250° C., more preferably from 100 to 140° C. The development time is preferably from 1 to 180 seconds, more preferably from 10 to 90 seconds.

For preventing uneven processing due to dimensional changes in the heat-developable photosensitive material of the present invention during heat development, it is preferable to heat the material at a temperature of 80° C. or above and less than 115° C. for 5 seconds or more so as to prevent the image from appearing, and then For preventing uneven processing due to dimensional changes in the heat-developable photosensitive material of the present invention during heat development, it is preferable to heat the material at a temperature of 80° C. or above and less than 115° C. for 5 seconds or more so as to prevent the image from appearing, and then develop the material by heating at a temperature of 110 to 140° C. to produce the image (so-called multi-stage heating method).

The present invention will be explained in more detail with reference to the following examples. However, materials, reagents, ratios, operations and so forth described hereinafter are properly be altered without departing from the spirit of the present invention. The scope of the present invention, therefore, is not limited to specific embodiments described below.

EXAMPLES

Structural formulae of the compounds used in the embodiments are shown below:

Dye A

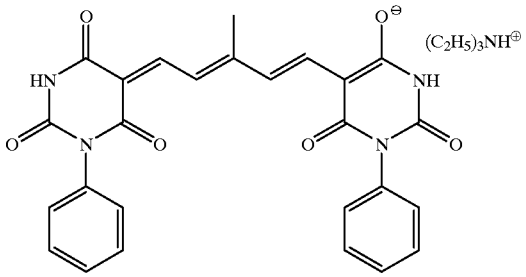

Coloring matter S-1

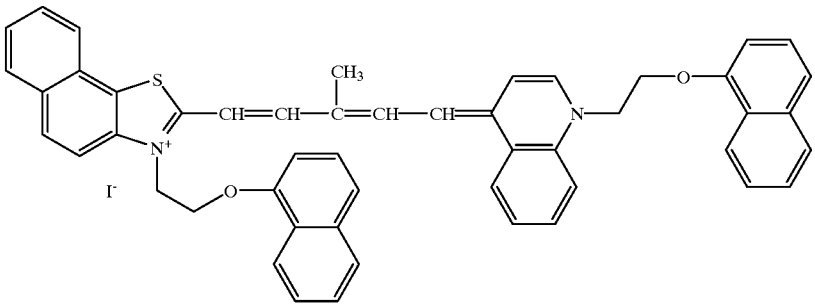

Compound-1

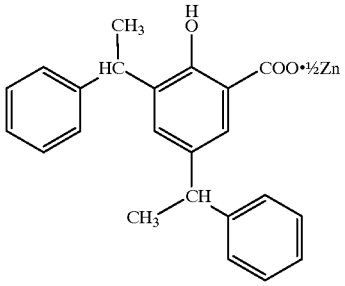

Compound-2

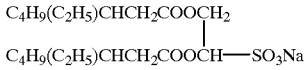

-continued

Compound-3

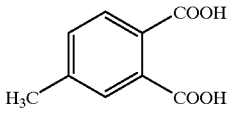

Compound-4

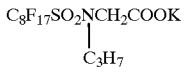

Compound-5

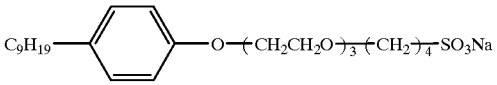

Compound-6

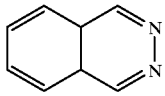

Example 1

On a 100 μm thick PET base, the layers shown below were formed by coating in this order, then respectively dried at 180° C. for 4 minutes.

Coating of Back Layer

| First Back Layer | |
|---|---|
| JURIMER ET-410 (Nippon Jun'yaku KK) | 38 mg/m$^2$ |
| $SnO_2$/Sb (9/1 by weight, acicular microparticle, product of Ishihara Sangyo Kaisha, Ltd., product name FS-10D) | 200 mg/m$^2$ |
| Dye A | 20 mg/m$^2$ |
| Matting agent (polymethylmethacrylate microparticle, Average particle size 5 μm) | 10 mg/m$^2$ |
| Crosslinking agent (DDENACOL EX-614B, product of Nagase Chemicals Ltd.) | 13 mg/m$^2$ |
| **Second Back Layer** | |
| Latex binder (CHEMIPEARL S-120, product of Mitsui Chemical Co., Ltd.) | 500 mg/m$^2$ |
| Colloidal silica (SNOWTEX-C, product of Nissan Chemical Industries, Ltd.) | 40 mg/m$^2$ |
| Crosslinking agent (DENACOL EX-614B, product of Nagase Chemicals Ltd.) | 30 mg/m$^2$ |

Annealing of Support

After the back layer is formed by coating and dried, a first annealing was performed under a tension of 5 kg/cm$^2$ at 130° C. for 10 minutes, which was followed by a second annealing under a tension of 10 kg/cm$^2$ at 40° C. for 15 seconds.

Preparation of Silver Halide Grain

To 700 ml of water, 11 g of phthalated gelatin, 30 mg of potassium bromaide and 10 mg of sodium thiosulfonate were added, and after conditioned at pH5.0 and 35° C., 159 ml of an aqueous solution containing 18.6 g of silver nitrate and an aqueous solution containing 1 mol/l of potassium bromide were added by the controlled double jet method over 6.5 minutes while keeping the pAg at 7.7. Subsequently, 476 ml of an aqueous solution containing 55.4 g of silver nitrate and an aqueous solution containing 1 mol/l of potassium bromide were added by the controlled double jet method over 30 minutes while keeping the pAg at 7.7. Thereafter, 1 g of 4-hydroxy-6-methyl-1,3,3a,7-tetrazaindene was added to the mixture, and the pH of which was lowered to cause coagulation precipitation to thereby effect desalting. Then 0.1 g of phenoxyethanol was added, conditioned at pH5.9 and pAg8.2, to obtain silver bromide grain (cubic grain having an average grain size of 0.12 μm, a coefficient of variation of the projected area of 8% and a (100) plane ratio of 88%).

Thus obtained silver bromide was heated to 60° C., added with $8.5\times10^{-4}$ mol/mol Ag of sodium thiosulfonate, ripened for 120 minutes, rapidly cooled to 40° C., added with $1\times10^{-5}$ mol of Coloring matter S-1, $5\times10^{-5}$ mol of 2-mercapto-5-methylbenzimidazole and $5\times10^{-5}$ mol of N-methyl-N'-{3-(mercaptotetrazolyl)phenyl} urea, and rapidly cooled to 30° C., to obtain a silver halide emulsion.

Preparation of Organic Acid Silver Dispersion

A mixture of 4.4 g of stearic acid, 39.4 g of behenic acid and 770 ml of distilled water was added with 103 ml of an aqueous 1N NaOH solution under stirring at 90° C., allowed to react for 240 minutes, and cooled to 75° C. Subsequently, the mixture was added with 112.5 ml of an aqueous solution containing 19.2 g of silver nitrate was added over 45 seconds, allowed to stand for 20 minutes, and then cooled to 30° C. Thereafter, the solid content was separated by suction filtration, and washed with water until the conductivity of the filtrate became 30 μS/cm. Thus obtained solid content was added with 100 ml of a 10 wt % aqueous polyvinylalcohol solution, and further added with water to adjust the total weight of 270 g. The resulting mixture was preliminarily dispersed using an automatic mortar, and then thoroughly dispersed using a dispersion apparatus "Nanomizer" (trade name, product of Nanomizer, Ltd.) under a collision pressure of 1000 kg/cm$^2$, to obtain a dispersion of acicular particle with an average short axis length of 0.04 μm, an average long axis length of 0.8 μm and a coefficient of variation of 30%.

Preparation of Reducing Agent Dispersion

One hundred grams of 1,1-bis (2-hydroxy-3,5-dimethylphenyl)-3,5,5-trimethylhexane and 50 g of polyvinylalcohol were added with 850 g of water, and then mixed thoroughly to prepare a slurry. The slurry was then put into a vessel of a sandmill (¼G Sand Grinder Mill, product of Aimex Ltd.) together with 840 g of dispersion beads (zirconia grain with an average diameter of 0.5 mm), and dispersed for 5 hours to obtain a reducing agent dispersion with an average particle size of 0.5 μm.

Preparation of Organic Polyhalide Compound

Thirty-five grams of tribromomethylphenylsulfone, 15 g of 2-tribromomethylnaphthalene and 10 g of Kuraray Poval MP-203 (product of Kuraray Co., Ltd.) were added with 940 g of water, and were then thoroughly mixed to prepare a slurry. The slurry was dispersed using zirconia beads as described above in relation to the reducing agent, to obtain a dispersion with an average particle size of 0.4 μm.

Preparation of Ultrahigh Contrast Agent Dispersion

Ten grams of the ultrahigh contrast agent (No. 62) described elsewhere in this specification and 2.5 g of Kuraray Poval #217 (product of Kuraray Co., Ltd.) were added with 87.5 g of water, and were then dispersed using zirconia beads as described above in relation to the reducing agent, to obtain a dispersion with an average particle size of 0.3 μm.

Preparation of Salicylic Acid Derivative Dispersion

Ten grams of salicylic acid (Compound-1) and 2 g of Kuraray Poval were added with 88 g of water, and were then dispersed using zirconia beads as described above in relation to the reducing agent, to obtain a dispersion with an average particle size of 0.4 μm.

Preparation of Solid Dispersion of Photographically Useful Material Precursor

Fifteen grams of the photographically useful material precursor listed in Table 1 and 10 g of Kuraray Poval MP-203 (product of Kuraray Co., Ltd.) were added with 940 g of water, and were then thoroughly mixed to prepare a slurry. The slurry was further dispersed using zirconia beads as described above in relation to the reducing agent, to obtain a dispersion with an average particle size of 0.4 μm.

Formation by Coating of Functional Layer for the Present Invention

The functional layer was formed by coating on the opposite side, that is, the side not having the back layer, of the support according to the following composition:

SBR latex (LACSTAR #3307B, product of Dai-Nippon Ink & Chemicals, Inc., trade name "LACSTAR #3307", Tg=13° C., 49 wt %) 1 g/m$^2$ Solid dispersion of the photographically useful material $1.5\times10^{-2}$ mol/m$^2$ Above-described silver halide grain 0.3 g/m$^2$ as silver Formation by Coating of Intermediate Layer The intermediate layer was formed by coating on the above-described functional layer simultaneously therewith and dried.

Polymer latex (copolymer of methylmethacrylate/styrene/2-ethylhexylacrylate/2-hydroxyethylmethacrylate/metacrylic acid, copolymerization ratio=59/9/26/5/1, Tg=47° C.) 0.5 g/m$^2$ Preparation and Coating of Photosensitive Layer Coating Liquid The photosensitive layer was formed by coating on the intermediate layer provided on the functional layer.

One hundred grams of the above organic acid silver dispersion, 20 g of the reducing agent dispersion, 15 g of the organic polyhalide, 40 g of SBR latex (LACSTAR #3307B, product of Dai-Nippon Ink & Chemicals, Inc., Tg=13° C., 49 wt %), 40 g of 10 wt % Kuraray Poval MP-203, 20 g of the silver halaide emulsion, 2 g of the ultrahigh contrast agent dispersion, 0.01 g of 5-methylbenzotriazole, 2 mg of sodium dihydrogen phosphate, 1.4 g of the dispersion of Compound-1 as a derivative of salicylic acid and 6 mg of Dye A were added with 100 g of water, and then thoroughly mixed. The obtained coating liquid was coated so that the amount of coated silver reaches 1.5 g/m$^2$.

Preparation and Coating of Protective Layer Coating Liquid

Five hundred grams of 40 wt % polymer latex (copolymer of methylmethacrylate/styrene/2-ethylhexylacrylate/2-hydroxyethyl methacrylate/metacrylic acid, copolymerization ratio=59/9/26/5/1, Tg=47° C.) was added with 262 g of water, to which further sequentially added were 14 g of benzylalcohol as a filming aid, 2.5 g of Compound-2, 3.6 g of CELLOSOL 524 (product of Chukyo Oil and Fat, Ltd.), 12 g of Compound-3, 1 g of Compound-4, 2 g of Compound-5, 7.5 g of Compound-6 and 3.4 g of polymethylmethacrylate particle with an average particle size of 3 μm as a matting agent, further added withwater to total 1000 g, to prepare a coating liquid with a viscosity of 5 cp (at 25° C.), pH3.4. Thus obtained coating liquid was coated so that the amount of solid content of the polymer latex reaches 2 g /m$^2$.

The photosensitive layer and protective layer were simultaneously formed by coating in a stacked manner, and were dried at 60° C. for 2 minutes after the coating.

Evaluation of Photographic Properties

The heat-developable photosensitive material thus prepared was exposed with a semiconductor laser sensitometer at 780 nm, then subjected to heat development at 118 to 120° C. for 15 to 25 seconds, and the obtained image was measured with a densitometer using visible light. A minimum density (Dmin) as an index of fog, gradation and sensitivity were evaluated. The gradation was expressed as a slope of a linear portion in the characteristics curve. The sensitivity was expressed as a relative logarithmic value of the amount of the exposure presenting a density higher by 1.5 than Dmin. Results were shown in Table 1.

TABLE 1

| Heat-Developable Photosensitive Material | Photographically Useful Compound Precursor | Heat Development Conditions Temperature (° C.) | Time(sec) | Dmin | Gradation | Sensitivity |
|---|---|---|---|---|---|---|
| 1 (This Invention) | D-6 | 118 | 25 | 0.10 | 18.7 | −0.03 |
| | | 119 | 25 | 0.13 | 21.5 | Standard |
| | | 120 | 20 | 0.12 | 21.0 | −0.02 |
| | | 119 | 20 | 0.11 | 20.5 | −0.03 |
| 2 (This Invention) | D-32 | 118 | 25 | 0.11 | 18.9 | −0.02 |
| | | 119 | 25 | 0.13 | 20.6 | +0.01 |
| | | 120 | 20 | 0.13 | 20.2 | −0.02 |
| | | 119 | 20 | 0.12 | 19.5 | −0.04 |

TABLE 1-continued

| Heat-Developable Photosensitive Material | Photographically Useful Compound Precursor | Heat Development Conditions Temperature (° C.) | Time(sec) | Dmin | Gradation | Sensitivity |
|---|---|---|---|---|---|---|
| 3 (This Invention) | I-2 | 118 | 25 | 0.08 | 16.7 | −0.11 |
| | | 119 | 25 | 0.10 | 18.4 | −0.07 |
| | | 120 | 20 | 0.10 | 19.0 | −0.05 |
| | | 119 | 20 | 0.09 | 17.1 | −0.09 |
| 4 (This Invention) | I-5 | 118 | 25 | 0.09 | 17.0 | −0.11 |
| | | 119 | 25 | 0.12 | 19.2 | −0.06 |
| | | 120 | 20 | 0.11 | 18.8 | −0.03 |
| | | 119 | 20 | 0.10 | 17.1 | −0.10 |
| 5 | None | 118 | 25 | 0.21 | 19.3 | −0.07 |
| | 119 | 25 | 0.27 | 25.5 | +0.22 | |
| | | 120 | 20 | 0.30 | 27.1 | +0.31 |
| | | 119 | 20 | 0.13 | 22.5 | +0.15 |

Evaluation of Humidity Dependence of Development

The heat-developable photosensitive material was allowed to stand in a variety of environments differ in relative humidity at 25° C. for 2 hours, and them subjected to the heat development at 120° C for 20 seconds. The material was them measured with visible light as described above, and a minimum density (Dmin) as an index of fog, gradation and sensitivity were evaluated. Results were shown in Table 2.

| Heat-Developable Photosensitive Material | Photographically Useful Compound precursor | Relative Humidity (%) | Dmin | Gradation | Sensitivity |
|---|---|---|---|---|---|
| 1 (This Invention) | D-6 | 30 | 0.09 | 17.5 | −0.06 |
| | | 50 | 0.13 | 21.5 | Standard |
| | | 75 | 0.20 | 24.7 | +0.11 |
| 2 (This Invention) | D-32 | 30 | 0.10 | 18.3 | −0.05 |
| | | 50 | 0.13 | 22.3 | +0.03 |
| | | 75 | 0.21 | 25.0 | +0.14 |
| 3 (This Invention) | I-2 | 30 | 0.09 | 17.8 | −0.05 |
| | | 50 | 0.12 | 22.0 | +0.04 |
| | | 75 | 0.22 | 25.1 | +0.13 |
| 4 (This Invention) | I-5 | 30 | 0.11 | 18.0 | −0.05 |
| | | 50 | 0.15 | 21.9 | +o.05 |
| | | 75 | 0.23 | 25.2 | +0.18 |
| 5 | None | 30 | 0.10 | 17.7 | −0.05 |
| | | 50 | 0.27 | 25.5 | +0.22 |
| | | 75 | 0.45 | 23.7 | +0.53 |

Discussion on Evaluation Results

As is clear from Tables 1 and 2, the heat-developable photosensitive material of the present invention was proved to have an excellent gradation hardness and provides a stable property against fluctuation in heat development conditions.

What is claimed is:

1. A heat-developable photosensitive material comprising:

(a) at least one layer of photosensitive image-forming layer containing an organic silver salt, a photosensitive silver halide, a reducing agent and an organic binder; and (b) a layer containing a binder and a solid dispersion; the binder consisting of a water-dispersed thermoplastic resin, and the sold dispersion being made of a precursor of a photographically useful compound capable of releasing the photographically useful compound when heated to 100° C. or higher and not higher than heat development temperature, wherein said photographically useful compound is at least one compound selected from the group consisting of antifogging agents, development inhibitors, development accelerators and image stabilizing agents.

2. The heat-developable photosensitive material of claim 1, wherein the photographically useful material is a development inhibitor.

3. The heat-developable photosensitive material of claim 1, wherein the photographically useful material is a development accelerator.

4. The heat-developable photosensitive material of claim 1, wherein an ultrahigh contrast agent is further contained.

5. The heat-developable photosensitive material of claim 1, wherein the organic binder in the photosensitive image-forming layer is produced from a water-dispersed thermoplastic resin.

6. The heat-developable photosensitive material of claim 1, wherein the layer contains a photosensitive halide.

7. The heat-developable photosensitive material of claim 1, wherein the precursor of the photographically useful compound is expressed by formula (1) below:

$$R^{10}—CHR^{11}—CR^{12}R^{13}—A^{11} \quad (1)$$

wherein, $R^{10}$ represents an electron attractive group;

$R^{11}$, $R^{12}$ and $R^{13}$ independently represent a hydrogen atom, an alkyl group, which may be substituted, or an aryl group, which may be substituted; and $A^{11}$ represents a photographically useful group bonded through a hetero atom, wherein the photographically useful group is a precursor to a photographically useful compound, which is at least one compound selected from group consisting of antifogging agents, development inhibitors, development accelerators and image stabilizing agents.

8. The heat-developable photosensitive material of claim 1, wherein the precursor of the photographically useful compound is expressed by formula (2) below:

$$R^{21}—S—SO_2—R^{22} \quad (2)$$

wherein, $R^{21}$ represents a heterocyclic group having formula (4):

(4)

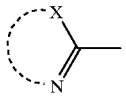

wherein X represents an atomic group required for forming a five- or six-membered hetero ring, where the hetero ring may be monocyclic or may form a condensed ring together with other rings and the heterocyclic group of formula (4) may have further substituents; and $R^{22}$ represents an aliphatic hydrocarbon group, an aryl group, an alkoxycarbonyl group, an aryloxycarbonyl group or a heterocyclic group, all of which may be substituted.

9. A heat-developable photosensitive material according to claim 1, wherein the photographically useful compound is selected from a group consisting of mercaptotetrazoles, mercaprotriazoles, mercaptothiazoles, mercaptobenzothiazoles, mercaptobenzooxazoles, mercaptobenzoselenazoles, benzotriazoles, indazoles, mercaptooxadiazole, and mercaptotriazines.

10. A heat-developable photosensitive material comprising:

(a) at least on layer of a photosensitive image-forming layer containing an organic silver salt, a photosensitive silver halide, a reducing agent and an organic binder; and (b) a layer containing a binder and a solid dispersion, wherein the binder consists of a water-dispersed thermoplastic resin, and the solid dispersion is a precursor selected from the group consisting of compounds represented by formula (1) below:

$$R^{10}—CHR^{11}—CR^{12}R^{13}—A^{11} \quad (1)$$

wherein, $R^{10}$ represents an electron attractive group;

$R^{11}$, $R^{12}$ and $R^{13}$ independently represent a hydrogen atom, an alkyl group, which may be substituted, or an aryl group, which may be substituted; and $A^{11}$ represents a photographically useful group bonded through a hetero atom; or compounds represented by formula (2) below:

$$R^{21}—SO_2—R^{22} \quad (2)$$

wherein, $R^{21}$ represents a heterocyclic group having formula (4):

(4)

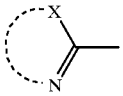

wherein X represents an atomic group required for forming a five- or six-membered hetero ring, where the hetero ring may be monocyclic or may form a condensed ring together with other rings and the heterocyclic group of formula (4) may have further substituents; and $R^{22}$ represents an aliphatic hydrocarbon group, an aryl group, an alkoxycarbonyl group, an aryloxycarbonyl group or a heterocyclic group, all of which may be substituted, wherein the photographically useful group is a precursor to a photographically useful compound, which is at least one compound selected from group consisting of antifogging agents, development inhibitors, development accelerators and image stabilizing agents.

11. A heat-developable photosensitive material according to claim 10, wherein the photographically useful compound is selected from a group consisting of mercaptotetrazoles, mercaprotriazoles, mercaptothiazoles, mercaptobenzothiazoles, mercaptobenzooxazoles, mercaptobenzoselenazoles, benzotriazoles, indazoles, mercaptooxadiazole, and mercaptotriazines.

* * * * *